US010543690B2

(12) United States Patent
Katayama et al.

(10) Patent No.: US 10,543,690 B2
(45) Date of Patent: Jan. 28, 2020

(54) LIQUID EJECTION APPARATUS

(71) Applicant: BROTHER KOGYO KABUSHIKI KAISHA, Nagoya-shi, Aichi-ken (JP)

(72) Inventors: Hiroshi Katayama, Nagoya (JP); Keita Sugiura, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/192,107

(22) Filed: Nov. 15, 2018

(65) Prior Publication Data

US 2019/0299619 A1 Oct. 3, 2019

(30) Foreign Application Priority Data

Mar. 29, 2018 (JP) ..... 2018-064462

(51) Int. Cl.

| | |
|---|---|
| ***B41J 2/175*** | (2006.01) |
| ***B41J 2/18*** | (2006.01) |
| ***B41J 2/045*** | (2006.01) |
| ***B41J 2/14*** | (2006.01) |
| ***B41J 2/165*** | (2006.01) |
| ***B41J 29/38*** | (2006.01) |

(52) U.S. Cl.

CPC ..... *B41J 2/175* (2013.01); *B41J 2/14032* (2013.01); *B41J 2/14201* (2013.01); *B41J 2/165* (2013.01); *B41J 2/16526* (2013.01); *B41J 2/17593* (2013.01); *B41J 2/17596* (2013.01); *B41J 2/18* (2013.01); *B41J 29/38* (2013.01); *B41J 2002/14467* (2013.01); *B41J 2002/16594* (2013.01)

(58) Field of Classification Search

CPC ..... B41J 2/045; B41J 2/16526; B41J 2/175; B41J 2/17593; B41J 2/17596; B41J 29/38; B41J 2202/12

See application file for complete search history.

(56) References Cited

U.S. PATENT DOCUMENTS

| | | | | |
|---|---|---|---|---|
| 5,818,485 | A * | 10/1998 | Rezanka | B41J 2/175 347/89 |
| 7,971,981 | B2 * | 7/2011 | Nagashima | B41J 2/14233 347/17 |
| 8,371,685 | B2 * | 2/2013 | Kusunoki | B41J 2/04581 347/17 |
| 8,469,494 | B2 * | 6/2013 | Xie | B41J 2/18 347/65 |
| 8,517,518 | B2 * | 8/2013 | Kashu | B41J 2/1404 347/66 |
| 2008/0238980 | A1 | 10/2008 | Nagashima et al. | |

FOREIGN PATENT DOCUMENTS

| | | |
|---|---|---|
| JP | 2008-254196 A | 10/2008 |
| JP | 2009-208445 A | 9/2009 |

* cited by examiner

*Primary Examiner* — Anh T Vo

(74) *Attorney, Agent, or Firm* — Merchant & Gould P.C.

(57) ABSTRACT

A liquid ejection apparatus includes a head that defines an individual channel including a nozzle, a feed channel communicating a reservoir and an inlet port of the individual channel, and a feedback channel communicating the reservoir and an outlet port of the individual channel. A pump assembly has at least one pump. A controller is configured to drive the pump assembly to draw air into the individual channel through the nozzle, and to drive the pump assembly to apply a pressure in the individual channel from the feed channel toward the feedback channel.

34 Claims, 13 Drawing Sheets

LIQUID EJECTION APPARATUS

CROSS-REFERENCE TO RELATED APPLICATION

This application claims priority from Japanese Patent Application No. 2018-064462 filed on Mar. 29, 2018, the content of which is incorporated herein by reference in its entirety.

FIELD OF DISCLOSURE

Aspects of the disclosure relate to a liquid ejection apparatus including a feed channel and a feedback channel.

BACKGROUND

A known liquid ejection apparatus includes a plurality of droplet ejection elements (individual channels) each having a nozzle, a common channel (feed channel) communicating with the individual channels to feed a liquid from a sub-tank (reservoir) to each individual channel, and a common circulation channel (feedback channel) communicating with the individual channels to return the liquid from each individual channel to the reservoir

SUMMARY

Prior art devices may not easily eliminate air bubbles that may form in each individual channel. Purging, or expelling the liquid through the nozzles, may eliminate such air bubbles in the individual channels, but will increase liquid consumption. Further, neither circulation nor purging may eliminate air bubbles stagnant in stagnant areas in the individual channels.

One or more aspects of the present invention are directed to a liquid ejection apparatus that eliminates air bubbles in individual channels without increasing liquid consumption.

A liquid ejection apparatus according to one aspect of the present invention includes a head, a pump assembly and a controller. The head defines an individual channel including a nozzle, a feed channel communicating a reservoir an inlet port of the individual channel and a feedback channel communicating the reservoir and an outlet port of the individual channel. The pump assembly includes at least one pump. The controller configures to drive the pump assembly to draw air into the individual channel through the nozzle. The controller configures to drive the pump assembly to apply a pressure in the individual channel from the feed channel toward the feedback channel.

DETAILED DESCRIPTION

First Embodiment

Figure 1:
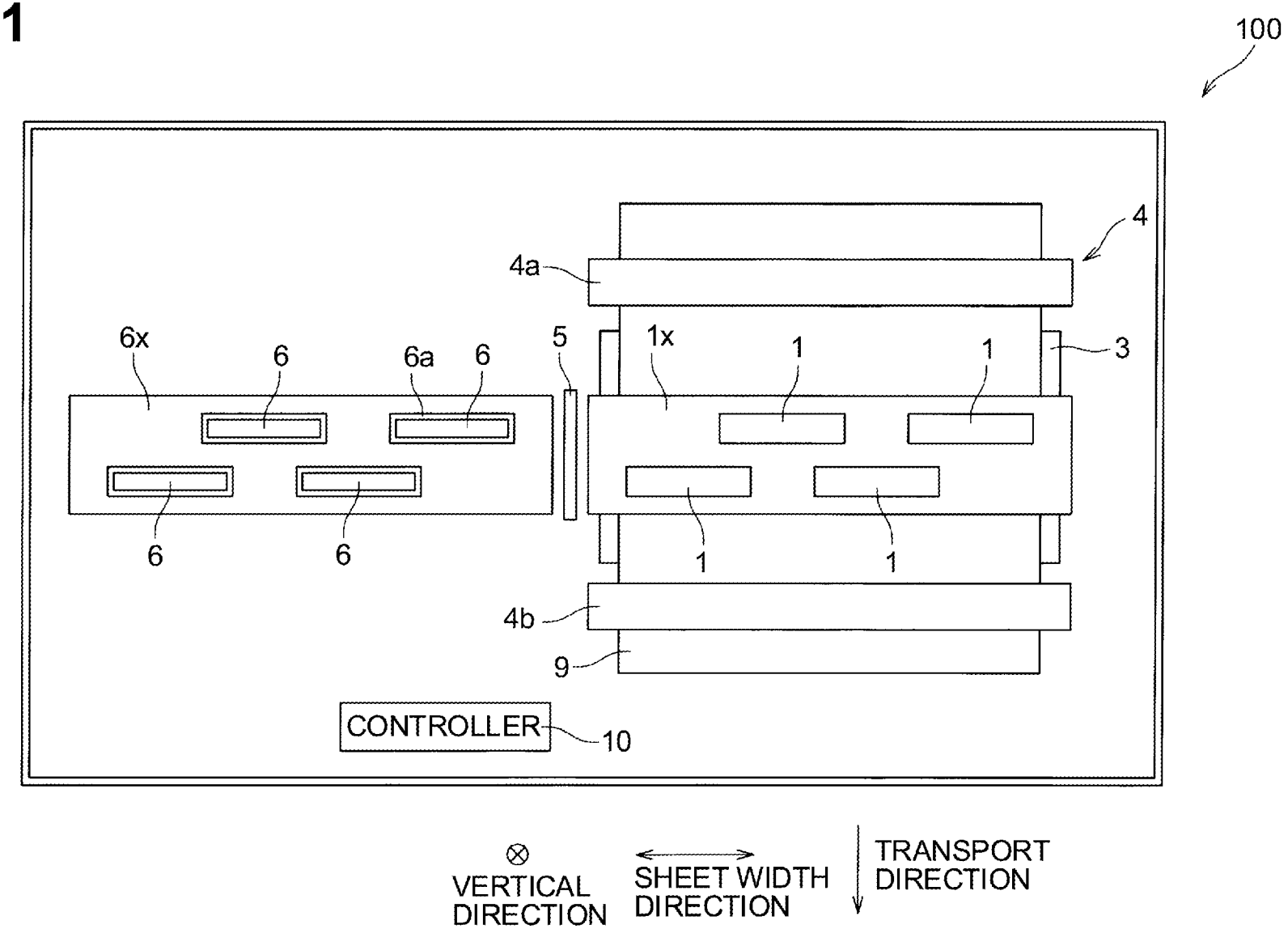
FIG. 1 is a plan view of a printer 100 according to a first embodiment.

The overall structure of a printer 100 according to a first embodiment of the present invention will be described with reference to FIG. 1.

The printer 100 includes a head unit 1*x*, a platen 3, a transport mechanism 4, a wiper 5, a cap unit 6*x*, and a controller 10.

A sheet of paper 9 is placed on the upper surface of the platen 3.

Figure 4:
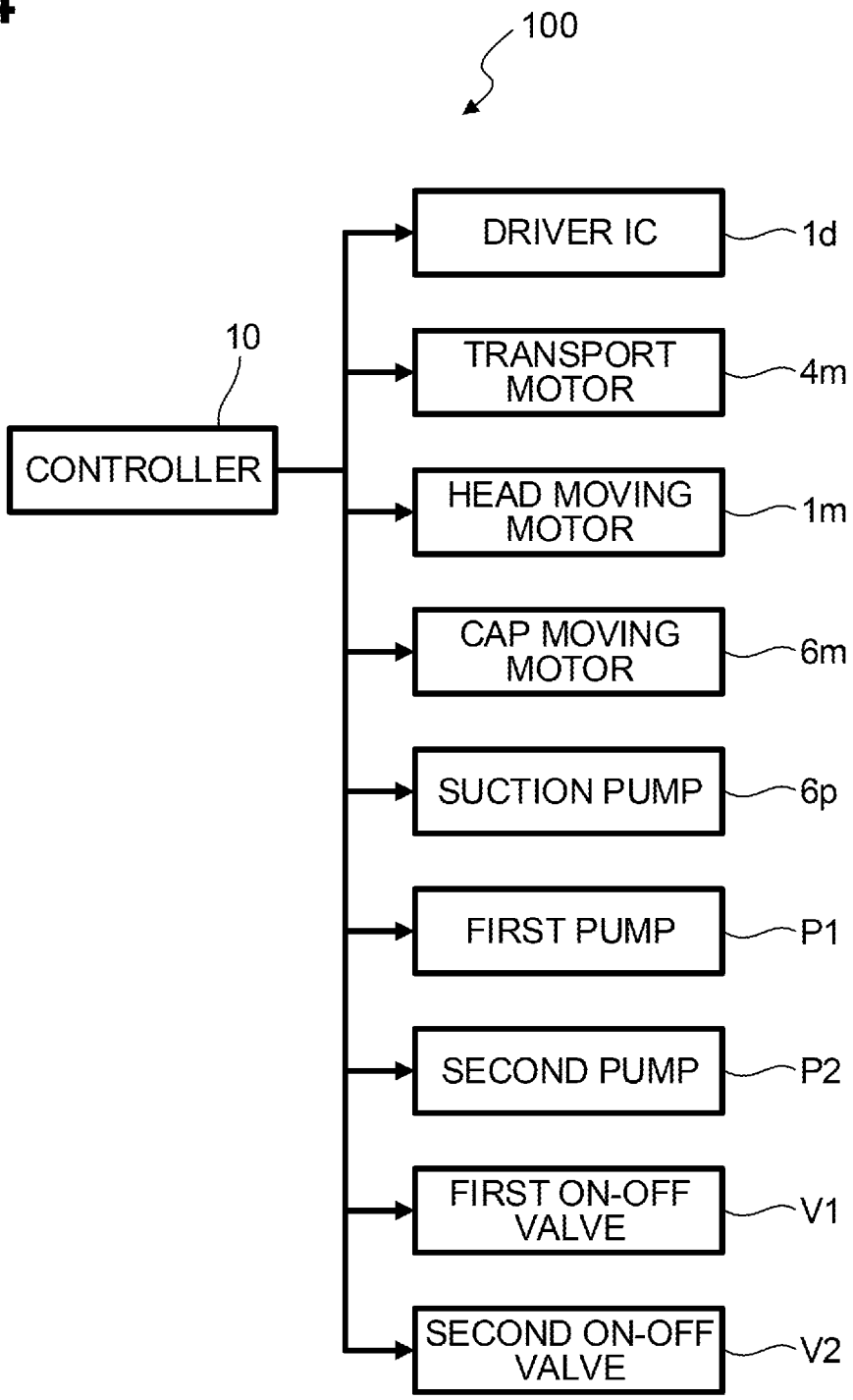
FIG. 4 is a block diagram of the printer 100 showing its electrical configuration.

The transport mechanism 4 includes two pairs of rollers 4*a* and 4*b* located on the opposite sides of the platen 3 in the transport direction. When the controller 10 drives a transport motor 4*m* (refer to FIG. 4), the roller pairs 4*a* and 4*b* rotate while holding the sheet 9 between the rollers in each pair to transport the sheet 9 in the transport direction.

Figure 2:
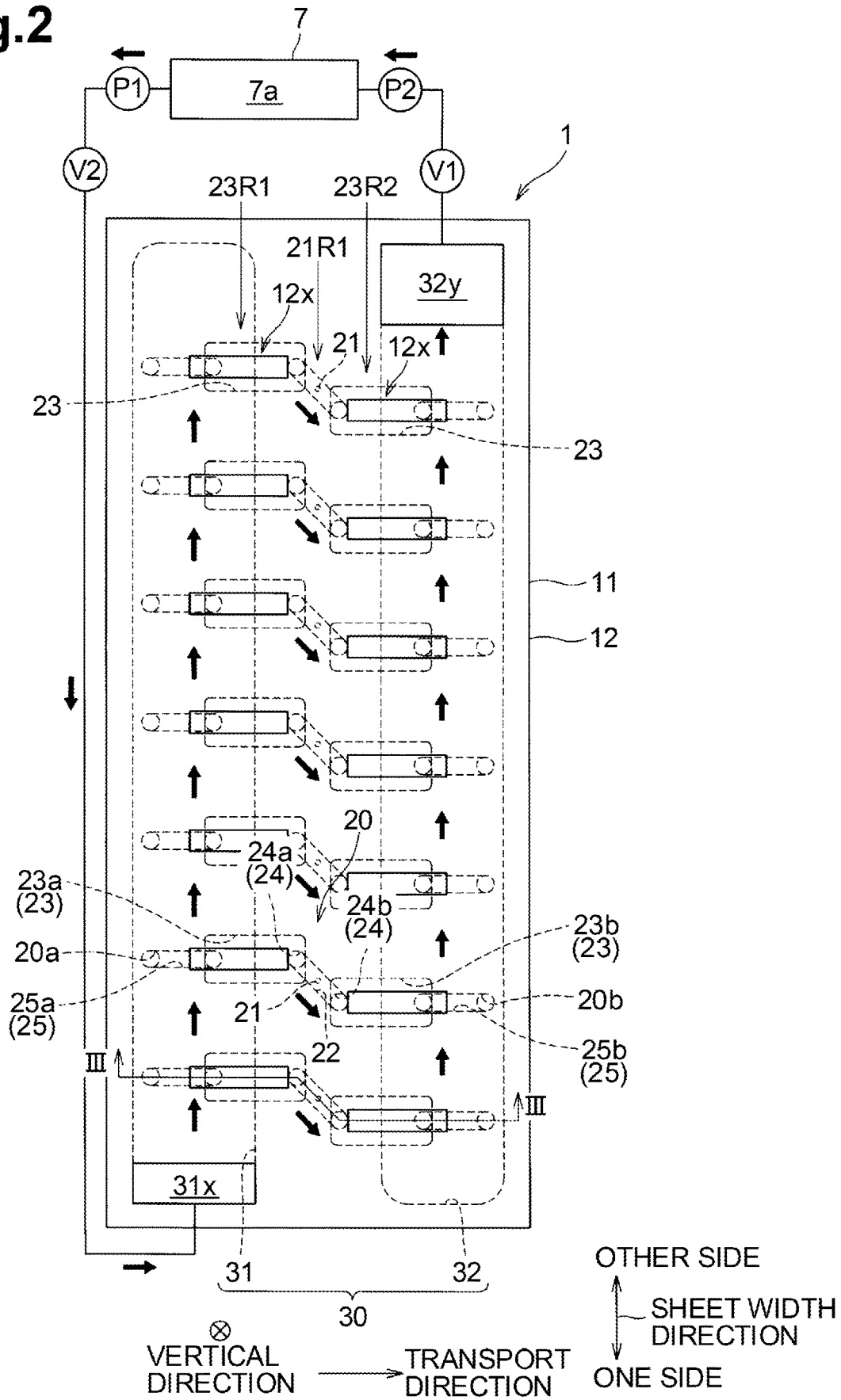
FIG. 2 is a plan view of a head 1 included in the printer 100.
Figure 3:
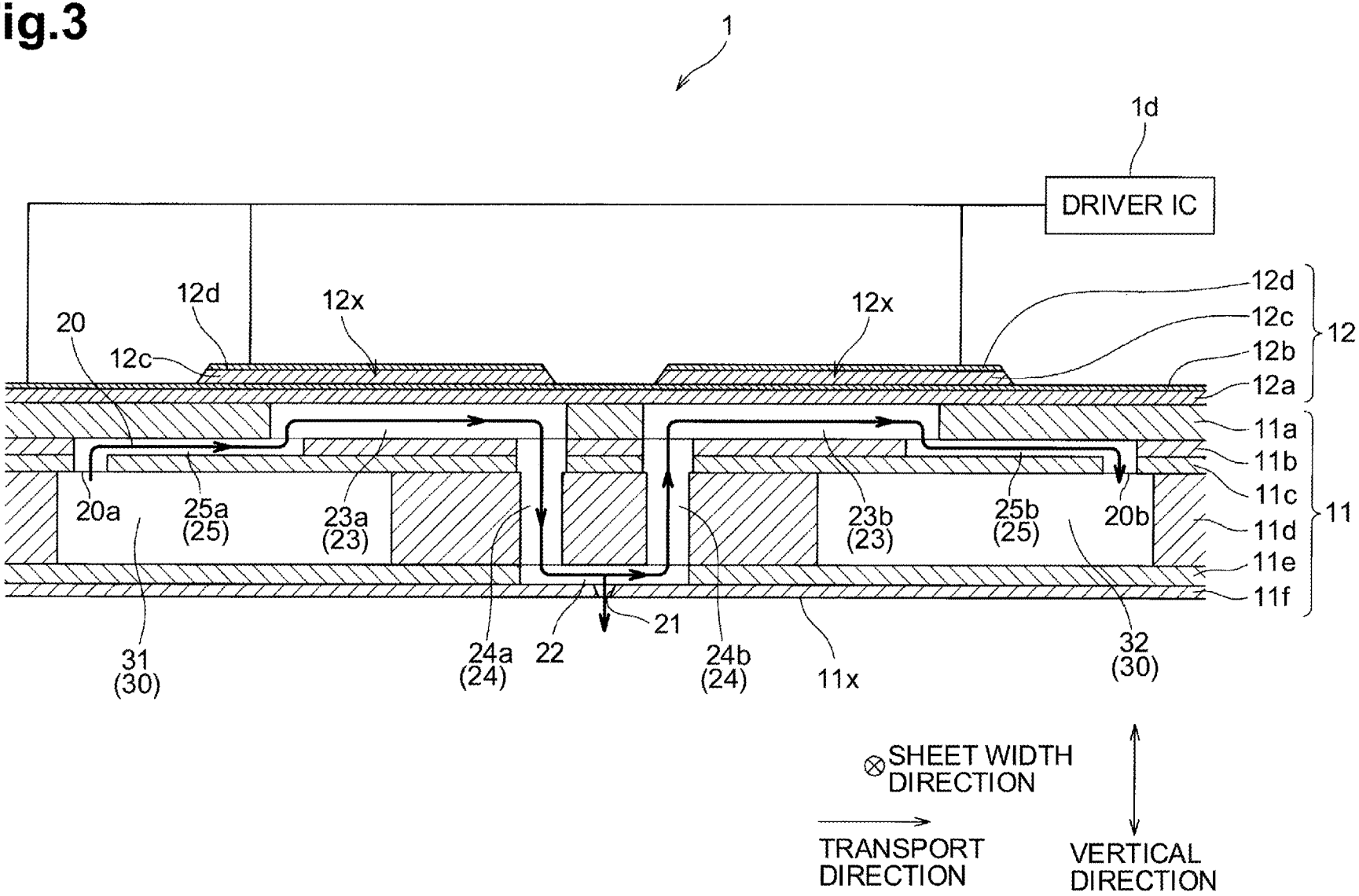
FIG. 3 is a cross-sectional view of the head 1 taken along line in FIG. 2.

The head unit 1*x* is used in a line printer, in which the head unit 1*x* at a fixed position ejects ink to the sheet 9 through nozzles 21 (refer to FIGS. 2 and 3). The head unit 1*x* is longer in the sheet width direction. The head unit 1*x* includes four heads 1 that are staggered in the sheet width direction. The lower surface of each head 1 is a nozzle surface 11*x* having a plurality of nozzles 21 (refer to FIG. 3). When the controller 10 drives a driver integrated circuit (IC) 1*d* (refer to FIGS. 3 and 4) in each head 1, each head 1 ejects ink selectively through the plurality of nozzles 21.

The sheet width direction is perpendicular to the transport direction. The sheet width direction and the transport direction are both perpendicular to the vertical direction.

The wiper 5 is a flexible plate that extends vertically. The wiper 5 is used in a wiping process (for wiping the nozzle surfaces 11*x*). The wiper 5 is located between the platen 3 and the cap unit 6*x* in the sheet width direction, and is adjacent to the head unit 1*x* at a recording position (position in FIG. 1) in the sheet width direction.

The cap unit 6*x* includes four caps 6 corresponding to the four heads 1 included in the head unit 1*x*. Each cap 6 includes an elastic looped lip 6*a*. The four caps 6 communicate with a waste ink tank (not shown) through a suction pump 6*p* (refer to FIG. 4). The cap unit 6*x* is used in a capping process (for sealing the nozzle surfaces 11*x*) and in a suction purge process (for drawing the ink out of the nozzles 21). The cap unit 6*x* is located adjacent to the head unit 1*x* at the recording position in the sheet width direction with the wiper 5 between them.

The head unit 1*x* is at the recording position except during the wiping process, the capping process, or the suction purge process.

In the wiping process, the controller 10 drives a head moving motor 1*m* (refer to FIG. 4) to move the head unit 1*x* from the recording position toward the wiper 5 in the sheet width direction. With the nozzle surfaces 11*x* (refer to FIG. 3) in contact with the wiper 5, the head unit 1*x* moves in the sheet width direction to move the nozzle surfaces 11*x* relative to the wiper 5. The wiper 5 wipes the ink and any foreign matter (e.g., powdery paper dust) off the nozzle surfaces 11*x*.

In the capping process, the controller 10 drives the head moving motor 1*m* (refer to FIG. 4) to move the head unit 1*x* from the recording position toward the cap unit 6*x* in the sheet width direction until each head 1 overlaps its corresponding cap 6 in the vertical direction. Subsequently, the controller 10 drives a cap moving motor 6*m* (refer to FIG. 4) to move the cap unit 6*x* slightly upward. At this position, the lips 6*a* of the caps 6 are in contact with the nozzle surfaces 11*x* of the heads 1. The lips 6*a* thus seal the nozzle surfaces 11*x* of the heads 1 to prevent the nozzles 21 from drying.

In the suction purge process, the head unit 1*x* and the cap unit 6*x* are first moved to seal the nozzle surfaces 11*x* of the heads 1, as in the capping process. With the cap unit 6*x* sealing the nozzle surfaces 11*x*, the controller 10 drives the suction pump 6*p* (refer to FIG. 4) to apply a sucking force on the nozzle surfaces 11*x* of the heads 1. The ink in the nozzles 21 is thus discharged into the waste ink tank (not shown).

The controller 10 includes a read only memory (ROM), a random access memory (RAM), and an application specific integrated circuit (ASIC). The ASIC performs processes including a recording process, the wiping process, the capping process, and the suction purge process in accordance with programs stored in the ROM. In the recording process, the controller 10 controls the driver IC 1*d* in each head 1 (refer to FIGS. 3 and 4) and the transport motor 4*m* (refer to FIG. 4) in accordance with a command for recording input through an external device, such as a personal computer (PC), and records an image on the sheet 9.

The structure of each head 1 will now be described with reference to FIGS. 2 and 3.

The head 1 includes a channel substrate 11 and an actuator unit 12.

As shown in FIG. 3, the channel substrate 11 includes six plates 11*a* to 11*f*, which are bonded together. The plate 11*d* includes common channels 30. The plates 11*a* to 11*f* include a plurality of individual channels 20 that communicate with the common channels 30.

As shown in FIG. 2, the common channels 30 include a feed channel 31 and a feedback channel 32 arranged in the transport direction. The feed channel 31 and the feedback channel 32 each extend in the sheet width direction. The feed channel 31 communicates with a reservoir 7*a* in a sub-tank 7 through an inlet port 31*x*. The feedback channel 32 communicates with the reservoir 7*a* through an outlet port 32*y*.

The sub-tank 7 is mounted on the head 1. The reservoir 7*a* communicates with a main tank (not shown) storing ink, and stores ink fed from the main tank.

A channel connecting the inlet port 31*x* and the reservoir 7*a* has a first pump P1 and a second on-off valve V2. A channel connecting the outlet port 32*y* and the reservoir 7*a* has a second pump P2 and a first on-off valve V1.

The controller is configured to drive a pump assembly, which in the illustrated examples includes the pumps P1 and P2. The pumps P1 and P2 are bidirectional pumps. More specifically, the pumps P1 and P2 are operable both forward for applying a pressure acting from the feed channel 31 toward the feedback channel 32, and backward for applying a pressure acting from the feedback channel 32 toward the feed channel 31. In other examples, the pump assembly includes other pump configurations.

The on-off valves V1 and V2 are switchable between an open mode that allows ink to flow and a closed mode that prevents ink from flowing. For example, the on-off valves V1 and V2 are switched from the open mode to the closed mode when ink is fed from the main tank to the sub-tank 7 to prevent the ink from leaking through the nozzles 21.

The thick arrows in FIGS. 2 and 3 represent the flow of ink.

As shown in FIG. 2, the ink in the reservoir 7*a* is fed to the feed channel 31 through the inlet port 31*x* when the controller 10 drives the pumps P1 and P2 forward with the first and second on-off valves V1 and V2 open. The ink fed to the feed channel 31 flows from one end to the other in the sheet width direction, while entering the individual channels 20. The ink entering each individual channel 20 flows into the feedback channel 32, and flows from one end to the other in the sheet width direction in the feedback channel 32. The ink is discharged from the feedback channel 32 through the outlet port 32*y* and returns to the reservoir 7*a*.

Each individual channel 20 includes a nozzle 21, a communication channel 22, two pressure chambers 23, two connection channels 24, and two linking channels 25. As shown in FIG. 3, the nozzle 21 is a through-hole in the plate 11*f*. The communication channel 22 is located directly above the nozzle 21. The communication channel 22 is a through-hole in the plate 11*e*. The pressure chambers 23 are through-holes in the plate 11*a*. The connection channels 24 are through-holes in the plates 11*b* to 11*d*, and extend in the vertical direction. Each connection channel 24 has a larger cross section than the communication channel 22. Each connection channel 24 thus corresponds to a large channel of the claimed invention. The linking channels 25 are through-holes in the plates 11*b* and 11*c*.

The pressure chambers 23 include a first pressure chamber 23*a* and a second pressure chamber 23*b*. The connection channels 24 include a first connection channel 24*a* and a second connection channel 24*b*. The linking channels 25 include a first linking channel 25*a* and a second linking channel 25*b*. The first pressure chamber 23*a*, the first connection channel 24*a*, and the first linking channel 25*a* are on one side of the nozzle 21 in the transport direction, whereas the second pressure chamber 23*b*, the second connection channel 24*b*, and the second linking channel 25*b* are on the opposite side of the nozzle 21. The first pressure chamber 23*a*, the first connection channel 24*a*, and the first linking channel 25*a* are located between the nozzle 21 and the feed channel 31 in the transport direction, or at a position overlapping the feed channel 31 in the vertical direction. The second pressure chamber 23*b*, the second connection channel 24*b*, and the second linking channel 25*b* are located between the nozzle 21 and the feedback channel 32 in the transport direction, or at a position overlapping the feedback channel 32 in the vertical direction. A part of the first pressure chamber 23*a* and the first linking channel 25*a* overlap the feed channel 31 in the vertical direction. A part of the second pressure chamber 23*b* and the second linking channel 25*b* overlap the feedback channel 32 in the vertical direction.

The first pressure chamber 23*a* communicates with the nozzle 21 through the first connection channel 24*a* and the communication channel 22. The second pressure chamber 23*b* communicates with the nozzle 21 through the second connection channel 24*b* and the communication channel 22. The first pressure chamber 23*a* and the second pressure chamber 23*b* communicate with each other through the first connection channel 24*a*, the communication channel 22, and the second connection channel 24*b*. The first connection channel 24*a* connects one end of the first pressure chamber 23*a* nearer the nozzle 21 in the transport direction to one end of the communication channel 22 nearer the feed channel 31 in the transport direction. The second connection channel 24*b* connects one end of the second pressure chamber 23*b* nearer the nozzle 21 in the transport direction to the other end of the communication channel 22 in the transport direction. The first linking channel 25*a* links the feed channel 31 to the other end of the first pressure chamber 23*a* in the transport direction. The second linking channel 25*b* links the feedback channel 32 to the other end of the second pressure chamber 23*b* in the transport direction. The communication channel 22 has the nozzle 21 at its center in the transport direction.

Each individual channel 20 has an inlet 20*a* connecting to the feed channel 31 and an outlets 20*b* connecting to the feedback channel 32. The inlet 20*a* corresponds to an end of the first linking channel 25*a* opposite to the first pressure chamber 23*a*. The outlet 20*b* corresponds to an end of the second linking channel 25*b* opposite to the second pressure chamber 23*b*.

The ink entering each individual channel 20 through the inlet 20*a* flows substantially horizontally through the first linking channel 25*a* and the first pressure chamber 23*a*, and then downward through the first connection channel 24*a* into the communication channel 22. The ink then flows horizontally through the communication channel 22 while partially being ejected through the nozzle 21. The remaining ink flows upward though the second connection channel 24*b*, and then substantially horizontally through the second pressure chamber 23*b* and the second linking channel 25*b* into the feedback channel 32 through the outlet 20*b*.

As shown in FIG. 2, the upper surface of the channel substrate 11 (the upper surface of the plate 11*a*) has a plurality of openings defined by the pressure chambers 23. The pressure chambers 23 form two pressure chamber rows 23R1 and 23R2. The two pressure chamber rows 23R1 and 23R2 each extend in the sheet width direction, and are arranged in the transport direction. The pressure chambers 23 in the pressure chamber rows 23R1 and 23R2 are arranged at the same position in the transport direction and at equal intervals in the sheet width direction. In contrast, the pressure chambers 23 in the pressure chamber rows 23R1 and 23R2 are at different positions in the sheet width direction. Thus, all the pressure chambers 23 are at different positions in the sheet width direction.

The nozzles 21 on the lower surface of the channel substrate 11 (the lower surface of the plate 11*f*) or the nozzle surface 11*x* are at the same position in the transport direction and at equal intervals in the sheet width direction, thus forming a single nozzle row 21R1.

The actuator unit 12 is located on the upper surface of the channel substrate 11 to cover the plurality of pressure chambers 23.

As shown in FIG. 3, the actuator unit 12 includes a diaphragm 12*a*, a common electrode 12*b*, a plurality of piezoelectric elements 12*c*, and a plurality of individual electrodes 12*d* in this order from the bottom. The diaphragm 12*a* and the common electrode 12*b* extend across substantially the entire upper surface of the channel substrate 11 to cover the plurality of pressure chambers 23. In contrast, the piezoelectric elements 12*c* and the individual electrodes 12*d* are in one-to-one correspondence with the pressure chambers 23. Each piezoelectric element 12*c* and each individual electrode 12*d* face the corresponding pressure chamber 23.

The common electrode 12*b*, the diaphragm 12*a*, and the plates 11*a* to 11*c* have through-holes at positions corresponding to the inlet port 31*x* and the outlet port 32*y* (refer to FIG. 2). The inlet port 31*x* and the outlet port 32*y* are open in the upper surface of the head 1, and communicate with the feed channel 31 and the feedback channel 32 through the through-holes.

The plurality of individual electrodes 12*d* and the common electrode 12*b* are electrically connected to the driver IC 1*d*. The driver IC 1*d* maintains the electric potential of the common electrode 12*b* at a ground potential while changing the electric potential of each individual electrode 12*d*. More specifically, the driver IC 1*d* generates a drive signal in accordance with a control signal from the controller 10, and transmits the drive signal to each individual electrode 12*d*. This changes the electric potential of each individual electrode 12*d* from a ground potential to a predetermined drive potential. When the electric potential of the individual electrode 12*d* changes, the portions of the diaphragm 12*a* and the piezoelectric element 12*c* between the individual electrode 12*d* and the pressure chamber 23 (or specifically an actuator 12*x*) deform into a convex shape toward the pressure chamber 23. This changes the volume of the pressure chamber 23, and applies a pressure to the ink in the pressure chamber 23, thus ejecting the ink through the nozzle 21.

The actuator unit 12 includes a plurality of actuators 12*x* each facing the corresponding pressure chamber 23. In the present embodiment, the actuators 12*x* facing two pressure chambers 23 in each individual channel 20 can be driven at the same time to increase the travelling speed of the ink ejected through the nozzle 21.

Prior art devices may sufficiently eliminate air bubbles that may form in each individual channel. Purging, or expelling the liquid through the nozzles, may eliminate some air bubbles in the individual channels, but will also increase liquid consumption. Further, neither circulation nor purging may eliminate air bubbles stagnant in stagnant areas in the individual channels. Still further, some prior attempted solutions circulate a liquid between the reservoir and the individual channels to eliminate air bubbles in the feed channel, but this also may not satisfactorily address issues with air bubbles that form in individual channels. An example of a control method for eliminating air bubbles in the individual channels 20 in accordance with the present disclosure will now be described with reference to FIGS. 5 to 6B. In FIGS. 6A and 6B, the hatched areas indicate the ink in the individual channel 20.

Figure 5:
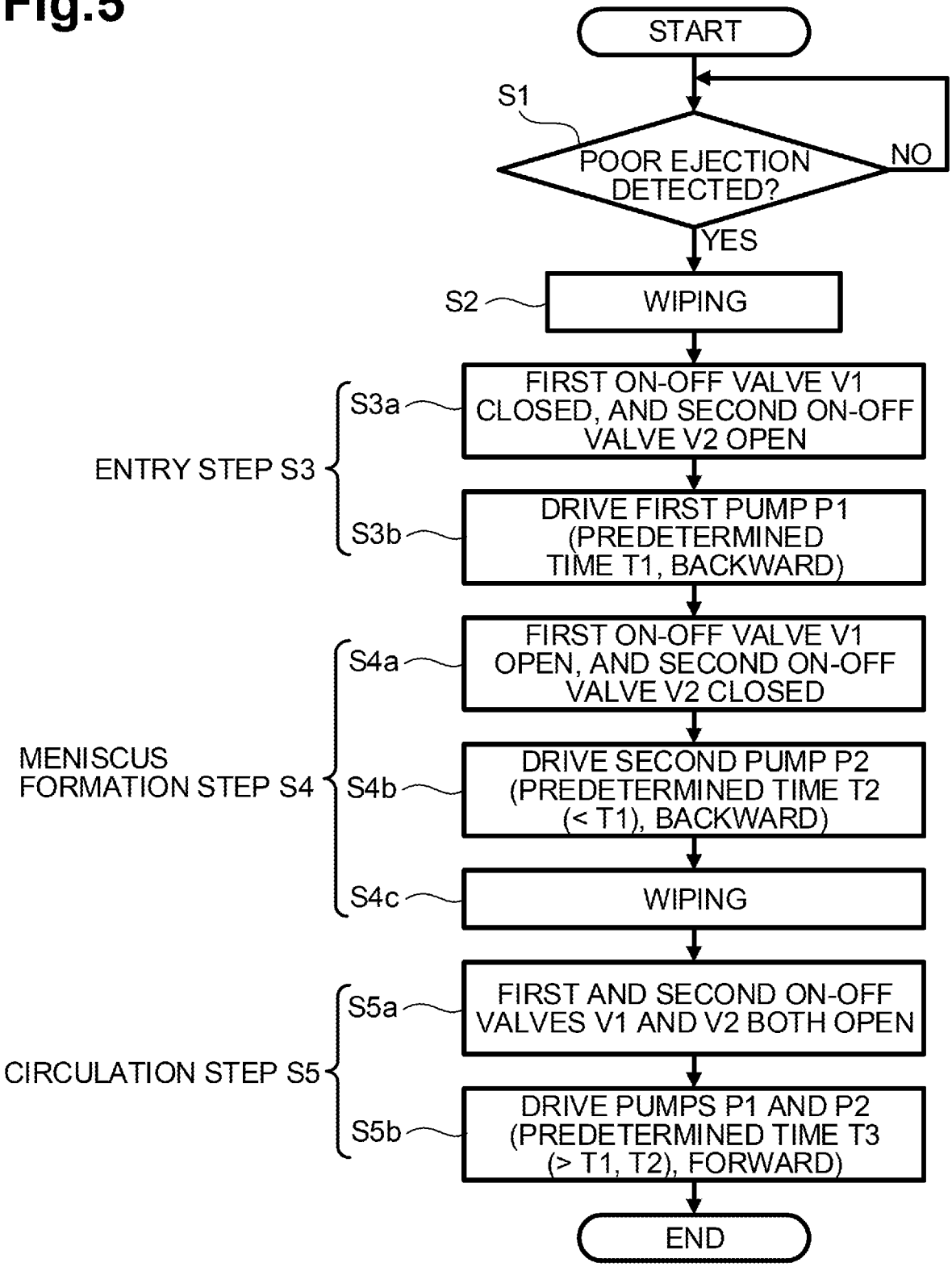
FIG. 5 is a flowchart showing control for eliminating air bubbles in individual channels 20 in the head 1 according to the first embodiment.
Figure 6A:
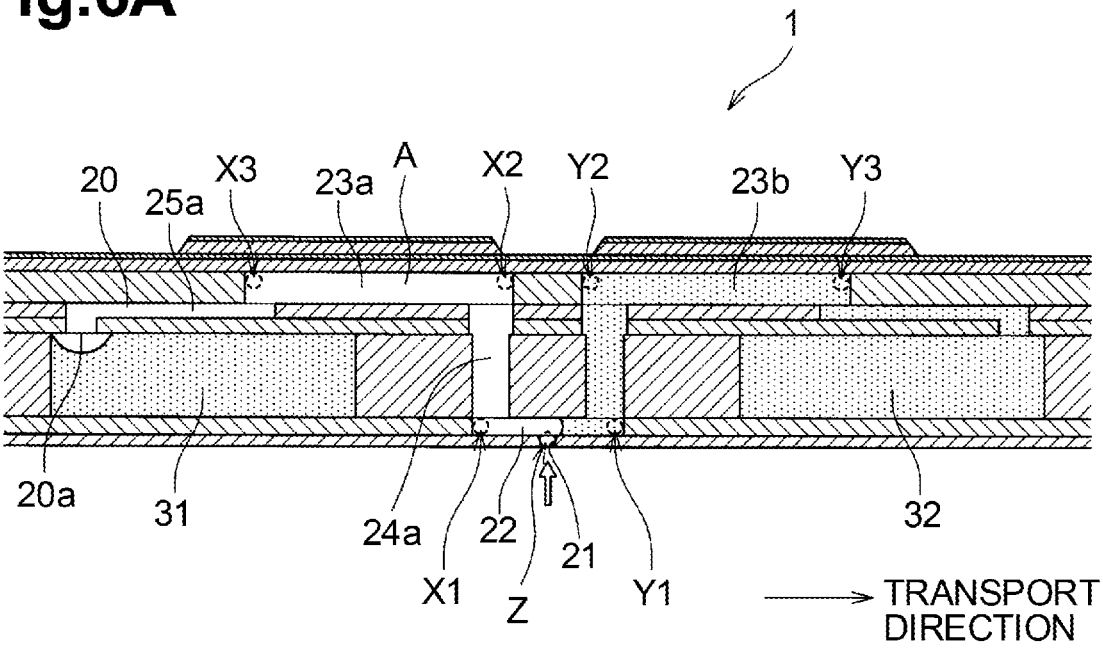
FIG. 6A is a cross-sectional view similar to FIG. 3 with air forced into the individual channel 20 through an entry step S3 shown in FIG. 5.
Figure 6B:
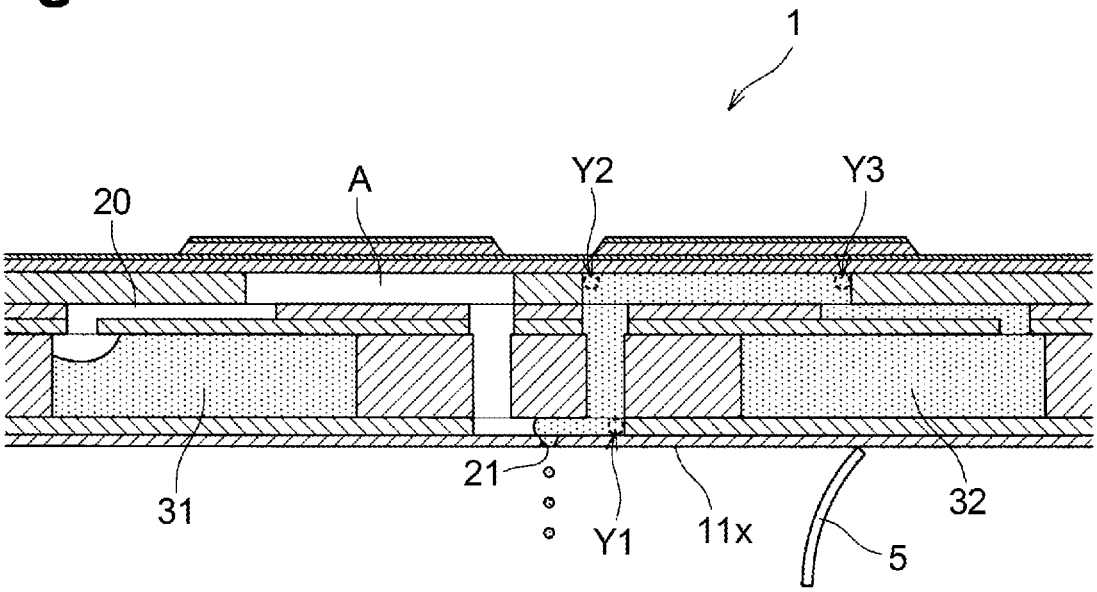
FIG. 6B is a cross-sectional view similar to FIG. 3 describing a meniscus formation step S4 shown in FIG. 5.

As shown in FIG. 5, the controller 10 first determines whether poor ejection through the nozzles 21 is detected (S1). The controller 10 may detect poor ejection through the nozzles 21 when, for example, receiving a detection signal from an external device input by a user or receiving a detection signal from a sensor included in the printer 100

(Yes in step S1). The sensor may, for example, read an image recorded on the sheet 9, and detect any poor ejection based on the image.

When no poor ejection through the nozzles 21 is detected (No in step S1), the controller 10 repeats the processing in step S1.

When poor ejection through the nozzles 21 is detected (Yes in step S1), the controller 10 performs the wiping process (S2). More specifically, the controller 10 drives the head moving motor 1*m* (refer to FIG. 4) to move the head unit 1*x* (refer to FIG. 1) from the recording position toward the wiper 5 in the sheet width direction. With the nozzle surfaces 11*x* (refer to FIG. 3) in contact with the wiper 5, the controller 10 moves the head unit 1*x* in the sheet width direction to move the nozzle surfaces 11*x* relative to the wiper 5. The wiper 5 thus wipes the ink and any foreign matter (e.g., powdery paper dust) off the nozzle surfaces 11*x*.

After step S2, the controller 10 causes air A to enter all the individual channels 20 in each head 1 through the nozzles 21 (S3: entry step). In step S3, the controller 10 first closes the first on-off valve V1 and opens the second on-off valve V2 in each head 1 (S3*a*). After step S3*a*, with the first on-off valve V1 closed and the second on-off valve V2 open in each head 1, the controller 10 drives the first pump P1 backward for a predetermined time T1 (S3*b*). This applies a pressure acting from the feedback channel 32 toward the feed channel 31 to the ink in each individual channel 20, drawing the air A into all the individual channels 20 in each head 1 through the nozzles 21 as shown in FIG. 6A.

The predetermined time T1 is, for example, 0.4 s when each individual channel 20 has a volume of 80 nl and the circulating ink has a flow rate of 100 nl/s. This time length is obtained in the manner described below. Each individual channel 20 has a volume of 40 nl from the inlet 20*a* to the nozzle 21. With the first on-off valve V1 closed in step S3, each individual channel 20 has an ink flow rate of 50 nl/s, whereas the on-off valves V1 and V2 are both open during circulation. Thus, 40 nl of ink will take 0.8 s to flow. The predetermined time T1 can be shorter as a larger pressure is applied to the ink from the pump P1.

In step S3, the air A enters through the nozzle 21 to near the inlet 20*a* in the feed channel 31. The air A then fills the nozzle 21 and substantially the half area in the communication channel 22 (area in the communication channel 22 from its substantially middle to one end in the transport direction), the first connection channel 24*a*, the first pressure chamber 23*a*, the first linking channel 25*a*, and the area near the inlet 20*a* in the feed channel 31. For example, the individual channel 20 may have air bubbles stagnant in stagnant areas X1 to X3, Y1 to Y3, and Z. When the air A enters the individual channel 20 in step S3, the air bubbles in the stagnant area Z in the nozzle 21 and in the stagnant areas X1 to X3 between the nozzle 21 and the feed channel 31 meet with the air A and disappear. The air bubbles in the stagnant areas Y1 to Y3 between the nozzle 21 and the feedback channel 32 remain stagnant in these areas in this state.

The stagnant areas X1 to X3, Y1 to Y3, and Z in the individual channel 20 are portions (corners) at which the ink flow changes and air bubbles are likely to be stagnant. The stagnant area Z corresponds to the nozzle 21. The stagnant area X1 corresponds to one end of the communication channel 22 in the transport direction. The stagnant area Y1 corresponds to the other end of the communication channel 22 in the transport direction. The stagnant area X2 corresponds to one end of the first pressure chamber 23*a* in the transport direction. The stagnant area X3 corresponds to the other end of the first pressure chamber 23*a* in the transport direction. The stagnant area Y2 corresponds to one end of the second pressure chamber 23*b* in the transport direction. The stagnant area Y3 corresponds to the other end of the second pressure chamber 23*b* in the transport direction.

After step S3, the controller 10 forms menisci in the nozzles 21 in all the individual channels 20 in each head 1 (S4: meniscus formation step). In step S4, the controller 10 first opens the first on-off valve V1 and closes the second on-off valve V2 in each head 1 (S4*a*). After step S4*a*, with the first on-off valve V1 open and the second on-off valve V2 closed, the controller 10 drives the second pump P2 backward in each head 1 for a predetermined time T2 (<T1) (S4*b*). This applies a pressure acting from the feedback channel 32 toward the feed channel 31 to the ink in each individual channel 20. This slightly moves the ink and the air A toward the feed channel 31 in all the individual channels 20 in each head 1 as shown in FIG. 6B, causing each nozzle 21 to be filled with ink, and a small amount of ink to be discharged through each nozzle 21. After step S4*b*, the controller 10 performs the wiping process (S4*c*). In the wiping process, the nozzle surfaces 11*x* move relative to the wiper 5 while being in contact with the wiper 5 as shown in FIG. 6B. This forms menisci in the nozzles 21.

The predetermined time T2 is, for example, about 0.1 s. The predetermined time T2 may be short to reduce ink consumption associated with meniscus formation.

After step S4, the controller 10 circulates the ink between the reservoir 7*a* and each individual channel 20 (S5: circulation step). In step S5, the controller 10 first opens both the first on-off valve V1 and the second on-off valve V2 in each head 1 (S5*a*). With both the first on-off valve V1 and the second on-off valve V2 open after step S5*a*, the controller 10 drives the first pump P1 and the second pump P2 forward in each head 1 for a predetermined time T3 (>T1 and T2) (S5*b*). This applies a pressure acting from the feed channel 31 toward the feedback channel 32 to the ink in each individual channel 20, thus circulating the ink between the reservoir 7*a* and each individual channel 20 (refer to FIG. 2). During circulation, the air A in each individual channel 20 flows together with ink through the area from the nozzle 21 to the outlet 20*b* in the individual channel 20 and through the feedback channel 32 into the reservoir 7*a*. In the reservoir 7*a*, the air A is separated from the liquid to be the air above the ink in the reservoir 7*a*.

In step S5*b*, the air A flows through the area from the nozzle 21 to the outlet 20*b* in the individual channel 20 together with the ink. Air bubbles in the stagnant areas Y1 to Y3 shown in FIGS. 6A and 6B meet with the air A and disappear.

After step S5, the controller 10 ends the routine.

As the pumps P1 and P2 are driven in step S5*b*, the ink receives a pressure that does not break the menisci in the nozzles 21 (meniscus-maintaining pressure). The first pump P1 applies a pressure to the ink in step S3*b* higher than the meniscus-maintaining pressure. The menisci in the nozzles 21 thus break in step S3*b*. The air A is then drawn through the nozzles 21. The second pump P2 also applies a pressure to the ink in step S4*b* higher than the meniscus-maintaining pressure. The menisci in the nozzles 21 thus break in step S4*b*. A small amount of ink is thus discharged from the nozzles 21.

As described above, the controller 10 according to the present embodiment forces the air A into the individual channels 20 through the nozzles 21 (entry step S3), forms menisci in the nozzles 21 in the individual channels 20 (meniscus formation step S4), and circulates the ink between the reservoir 7*a* and each individual channel 20 (circulation step S5) (refer to FIG. 5). As shown in FIGS. 6A and 6B, air bubbles in the individual channels 20 (air bubbles stagnant in the stagnant areas X1 to X3, Y1 to Y3, and Z, which are difficult to remove through the circulation step alone) can be removed from the individual channels 20 without increasing ink consumption.

In the present embodiment, the first pump P1 used in the circulation step S5 is used in the entry step S3 (refer to step S3*b* in FIG. 5). This structure uses a fewer components than the structure including a dedicated member (another pump) for the entry step S3.

In the entry step S3, the controller 10 forces the air A to at least one end of the first connection channel 24*a* (end opposite to the communication channel 22 or the upper end in FIG. 6A). The connection channel 24*a* with a larger cross section is filled with the air A to increase the flow rate of the air A in the circulation step S5, thus facilitating elimination of air bubbles.

In the entry step S3, the controller 10 forces the air A to at least the inlet 20*a* of each individual channel 20 (refer to FIG. 6A). In this case, air bubbles in the stagnant areas X1 to X3 in each individual channel 20 between the nozzle 21 and the feed channel 31 are eliminated in a reliable manner.

In the entry step S3, the controller 10 forces the air A to the feed channel 31 (refer to FIG. 6A). In this case, air bubbles in the area in each individual channel 20 from the nozzle 21 through the inlet 20*a* to the feed channel 31 are eliminated in a more reliable manner.

The controller 10 causes the first pump P1 to apply a higher pressure to the ink in the entry step S3 than the pumps P1 and P2 in the circulation step S5. In this case, the menisci in the nozzles 21 break in the entry step S3, and the air A is drawn through the nozzles 21, forcing the air A into the individual channels 20 in a reliable manner.

In the entry step S3, the controller 10 drives the first pump P1 for the predetermined time T1 (refer to step S3*b* in FIG. 5). This structure easily allows the air A to enter the individual channels 20 with relatively simple control.

In the entry step S3, the controller 10 drives the first pump P1 with the first on-off valve V1 closed to apply a pressure acting from the feedback channel 32 toward the feed channel 31 to the ink (refer to steps S3*a* and S3*b* in FIG. 5). Relatively simple control using the valve V1 and the pump P1 forces the air A into the individual channels 20 in a reliable manner. The valve V1 and the pump P1 are not dedicated to the entry step S3. The first on-off valve V1 may also be used to feed ink from the main tank to the sub-tank 7. The first pump P1 is also used in the circulation step S5. This structure uses a fewer components than the structure including a dedicated member (another valve or pump) for the entry step S3.

In the entry step S3, the controller 10 drives the first pump P1 with the first on-off valve V1 closed and the second on-off valve V2 open to apply a pressure acting from the feedback channel 32 toward the feed channel 31 to the ink (refer to steps S3*a* and S3*b* in FIG. 5). The controller 10 then drives the second pump P2 in the meniscus formation step S4, with the first on-off valve V1 open and the second on-off valve V2 closed to apply a pressure acting from the feedback channel 32 to the feed channel 31 to the ink (refer to steps S4*a* and S4*b* in FIG. 5). Relatively simple control using the valves V1 and V2 and the pumps P1 and P2 causes menisci to form in the nozzles 21 in a reliable manner. Similarly to the valve V1 and the pump P1, the valve V2 and the pump P2 are also not dedicated to the entry step S3 and the meniscus formation step S4. The second on-off valve V2 may also be used to feed ink from the main tank to the sub-tank 7. The second pump P2 is also used in the circulation step S5. This structure uses a fewer components than the structure including a dedicated member (another valve or pump) for the entry step S3 or for the meniscus formation step S4.

The controller 10 causes the second pump P2 to apply a higher pressure to the ink in the meniscus formation step S4 than the pumps P1 and P2 in the circulation step S5. In this case, menisci can form in the nozzles 21 in a more reliable manner.

In the meniscus formation step S4, the controller 10 drives the second pump P2 for the predetermined time T2 (shorter than the predetermined time T1 for which the first pump P1 is driven in the entry step S3) (refer to steps S3*b* and S4*b* in FIG. 5). In this case, less ink is discharged through the nozzles 21 in the meniscus formation step S4 (refer to FIG. 6B).

In the meniscus formation step S4, the controller 10 performs the wiping process (refer to step S4*c* in FIG. 5). The wiping process wipes extra ink around the nozzles 21 off the nozzle surfaces 11*x*, thus forming menisci in the nozzles 21 in a more reliable manner.

The controller 10 performs the wiping process (refer to step S2 in FIG. 5) before the entry step S3. In this case, foreign matter (e.g., powdery paper dust) on the nozzle surfaces 11*x* is wiped out before the entry step S3. This prevents foreign matter from entering the individual channels 20 through the nozzles 21 together with the air A in the entry step S3.

Each individual channel 20 includes two pressure chambers 23. In this case, the actuators 12*x* facing the two pressure chambers 23 in each individual channel 20 can be driven at the same time to increase the traveling speed of the ink ejected through the nozzle 21. However, each individual channel 20 with two pressure chambers 23 has a greater length than each individual channel 20 with a single pressure chamber 23, and thus can have many stagnant areas X1 to X3 and Y1 to Y3 as shown in FIGS. 6A and 6B in which air bubbles are easily stagnant. In the present embodiment, air bubbles stagnant in many of the stagnant areas X1 to X3 and Y1 to Y3 in the individual channels 20 can be eliminated through mainly steps S3 to S5.

The controller 10 performs the entry step S3 when detecting poor ejection through the nozzles 21 (Yes in step S1 in FIG. 5). In this case, poor ejection can be corrected in a timely manner.

The pumps P1 and P2 are operable both forward for applying a pressure acting from the feed channel 31 toward the feedback channel 32 to the ink, and also backward for applying a pressure acting from the feedback channel 32 toward the feed channel 31 to the ink. The controller 10 drives the first pump P1 backward in the entry step S3 (refer to step S3*b* in FIG. 5), and the pumps P1 and P2 forward in the circulation step S5 (refer to step S5*b* in FIG. 5). When the first pump P1 is driven forward in the entry step S3 and the pumps P1 and P2 are driven forward in the circulation step S5, air bubbles in the stagnant areas X1 to X3 in each individual channel 20 between the nozzle 21 and the feed channel 31 are difficult to eliminate, whereas air bubbles in the stagnant areas Y1 to Y3 in each individual channel 20 between the nozzle 21 and the feedback channel 32 can be eliminated. In the present embodiment, the first pump P1 is driven backward in the entry step S3 and the pumps P1 and P2 are driven forward in the circulation step S5, eliminating air bubbles both in the stagnant areas X1 to X3 in each individual channel 20 between the nozzle 21 and the feed channel 31 and in the stagnant areas Y1 to Y3 in each individual channel 20 between the nozzle 21 and the feedback channel 32.

Second Embodiment

Figure 7:
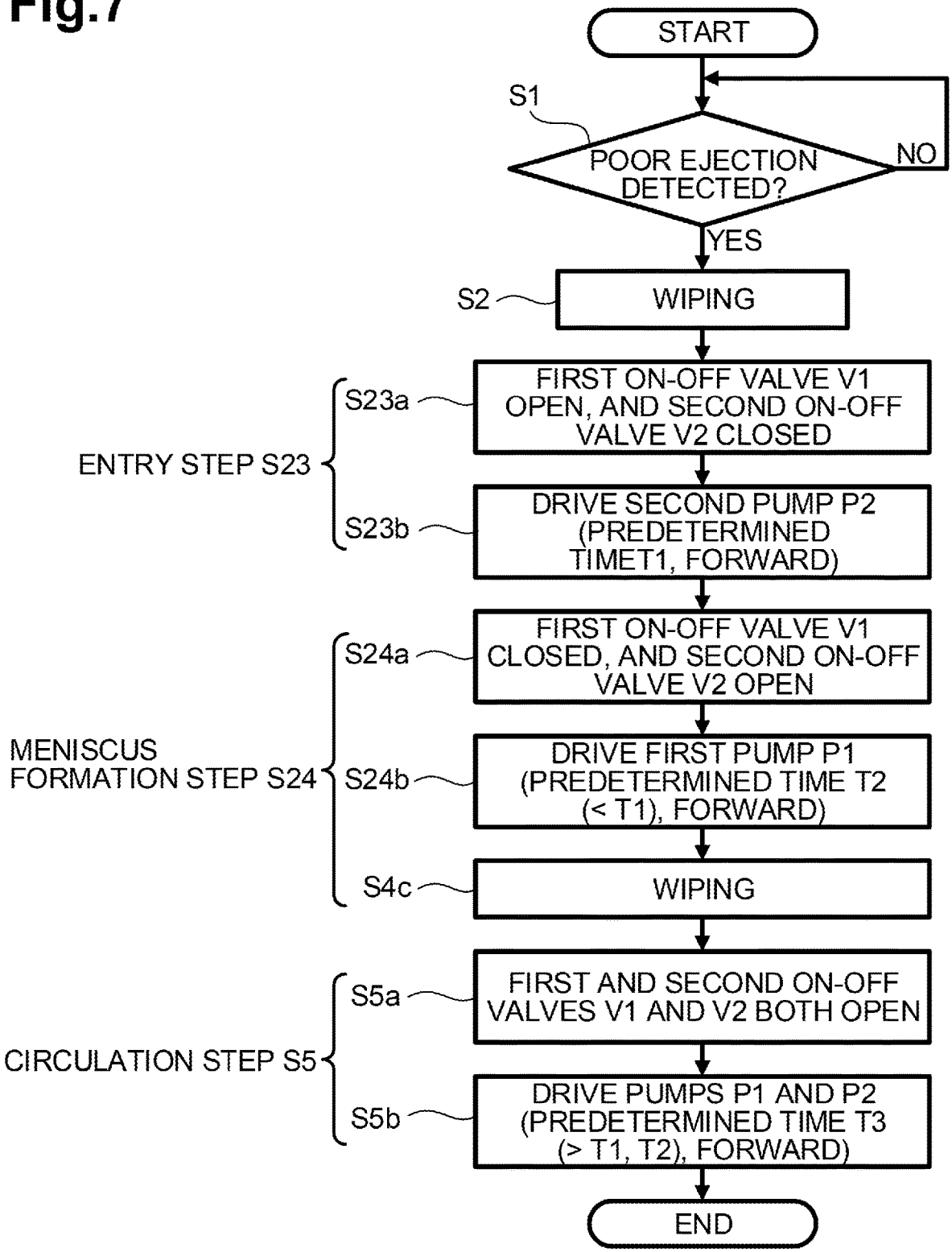
FIG. 7 is a flowchart showing control for eliminating air bubbles in the individual channels 20 in the head 1 according to a second embodiment.

A printer according to a second embodiment of the present invention will now be described with reference to FIGS. 7 and 8. The second embodiment differs from the first embodiment in its pumps P1 and P2 being unidirectional pumps (specifically, the pumps P1 and P2 operable forward but not operable backward) and its entry step S23 and its meniscus formation step S24, through which air bubbles in the individual channels 20 are eliminated.

Figure 8A:
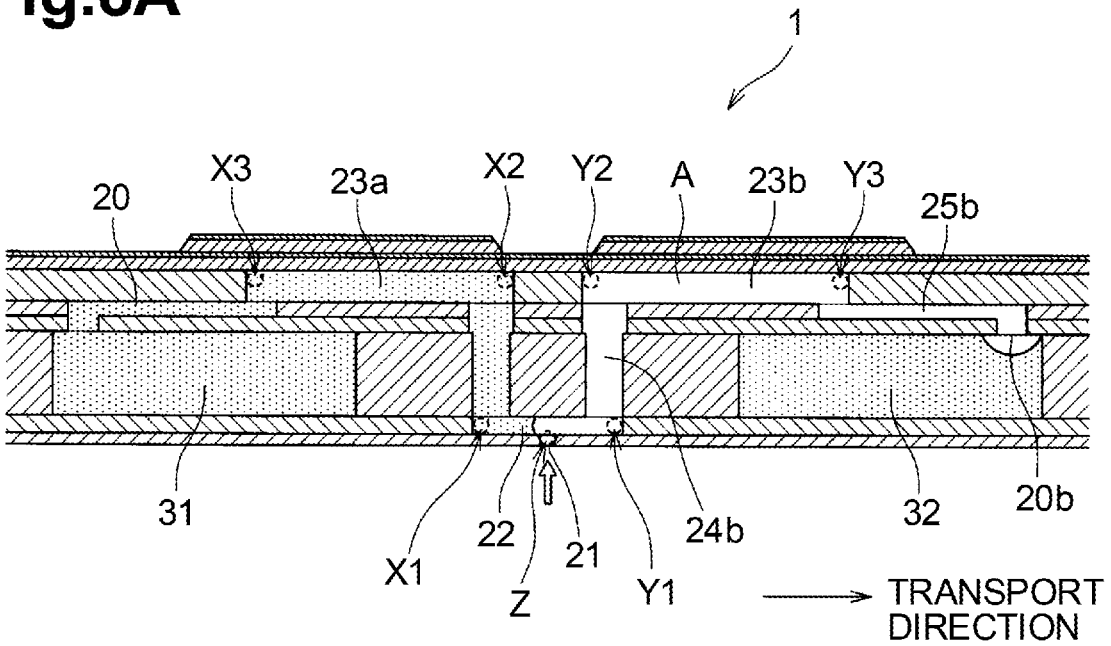
FIG. 8A is a cross-sectional view similar to FIG. 3 but with air forced into the individual channel 20 through an entry step S23 shown in FIG. 7.

In step S23, the controller 10 first opens the first on-off valve V1 and closes the second on-off valve V2 in each head 1 (S23*a*). After step S23*a*, with the first on-off valve V1 open and the second on-off valve V2 closed, the controller 10 drives the second pump P2 forward in each head 1 for the predetermined time T1 (S23*b*). This applies a pressure acting from the feed channel 31 toward the feedback channel 32 to the ink in each individual channel 20, drawing the air into all the individual channels 20 in each head 1 through the nozzles 21 as shown in FIG. 8A.

In step S23, the air A enters through the nozzle 21 to near the outlet 20*b* in the feedback channel 32. The air A then fills the nozzle 21 and substantially the half area in the communication channel 22 (area in the communication channel 22 from its substantially middle to the other end in the transport direction), the second connection channel 24*b*, the second pressure chamber 23*b*, the second linking channel 25*b*, and the area near the outlet 20*b* in the feedback channel 32. For example, the individual channel 20 may have air bubbles stagnant in stagnant areas X1 to X3, Y1 to Y3, and Z. When the air A enters the individual channel 20 in step S23, the air bubbles in the stagnant area Z in the nozzle 21 and in the stagnant areas Y1 to Y3 between the nozzle 21 and the feedback channel 32 meet with the air A and disappear. The air bubbles in the stagnant areas X1 to X3 between the nozzle 21 and the feed channel 31 remain stagnant in these areas.

Figure 8B:
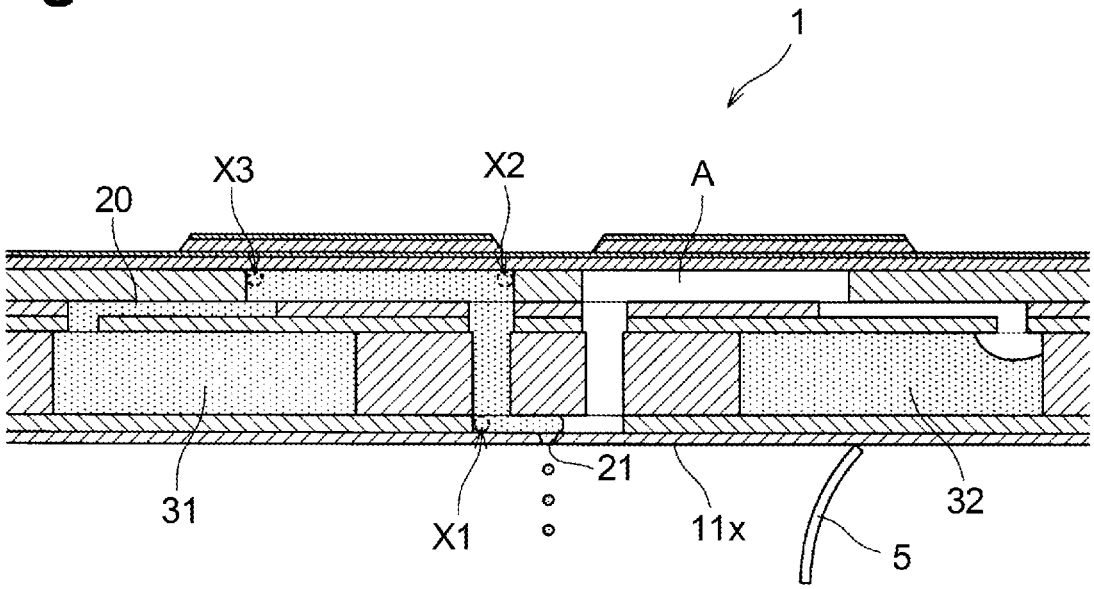
FIG. 8B is a cross-sectional view similar to FIG. 3 describing a meniscus formation step S24 shown in FIG. 7.

In step S24, the controller 10 first closes the first on-off valve V1 and opens the second on-off valve V2 in each head 1 (S24*a*). After step S24*a*, with the first on-off valve V1 closed and the second on-off valve V2 open, the controller 10 drives the first pump P1 forward in each head 1 for the predetermined time T2 (<T1) (S24*b*). This applies a pressure acting from the feed channel 31 toward the feedback channel 32 to the ink in each individual channel 20. The pressure slightly moves the ink and the air A toward the feedback channel 32 in all the individual channels 20 in each head 1 as shown in FIG. 8B, causing each nozzle 21 to be filled with ink, and a small amount of ink to be discharged through each nozzle 21.

After step S24*b*, the controller 10 performs the wiping process (S4*c*) as in the first embodiment.

After step S24, the controller 10 performs the processing in step S5 as in the first embodiment, and ends the routine. In step S5, the air A in each individual channel 20 flows together with the ink through the feedback channel 32, and returns to the reservoir 7*a*. In the reservoir 7*a*, the air A is separated from the liquid to be the air above the ink in the reservoir 7*a*. In the present embodiment, air bubble in the stagnant areas X1 to X3 can remain stagnant in these areas.

As describe above, the present embodiment has the advantageous effects described below, in addition to the same advantageous effects as produced in the first embodiment using the same structure as in the first embodiment.

The pumps P1 and P2 are operable forward for applying a pressure acting from the feed channel 31 toward the feedback channel 32 to the ink. The controller 10 drives the second pump P2 forward in the entry step S23, and drives the pumps P1 and P2 forward in the circulation step S5. In this case, air bubbles in the stagnant areas X1 to X3 in each individual channel 20 between the nozzle 21 and the feed channel 31 are difficult to remove. However, the unidirectional pumps P1 and P2, which are usually less expensive than bidirectional pumps, can save costs.

Third Embodiment

A printer according to a third embodiment of the present invention will now be described with reference to FIG. 9. The third embodiment differs from the first embodiment in that a suction purge process is performed after step S1 and before step S2 to eliminate air bubbles in the individual channels 20 (S32), and also the s 6*p* (refer to FIG. 4) is used instead of the valves V1 and V2 and the pumps P1 and P2 to perform a suction purge process (S34*a*) in a meniscus formation step S34.

In the present embodiment, the controller 10 performs the suction purge process (S32) when detecting poor ejection through the nozzles 21 (Yes in step S1). In step S32, the controller 10 first controls the head moving motor 1*m* (refer to FIG. 4) to move the head unit 1*x* (refer to FIG. 1) to below the cap unit 6*x* and seal the nozzle surface 11*x* of each head 1 with the cap unit 6*x*. With the cap unit 6*x* sealing the nozzle surfaces 11*x*, the controller 10 drives the suction pump 6*p* to draw the ink out of the nozzles 21 in the individual channels 20. In this process, the suction pump 6*p* also sucks any foreign matter (e.g., powdery paper dust) on the nozzle surfaces 11*x*.

After step S32, the controller 10 performs the processing in steps S2 and S3 (S3*a* and S3*b*) as in the first embodiment.

After step S3, the controller 10 forms menisci in the nozzles 21 in all the individual channels 20 in each head 1 (S34: meniscus formation step). In step S34, the controller 10 first performs the suction purge process through control similar to the control performed in step S32 (S34*a*). However, the controller 10 controls the operating time of the suction pump 6*p* to allow the suction pump 6*p* to apply a smaller suction force acting on the nozzle surfaces 11*x* in step S34 than in step S32. More specifically, less ink is discharged through the nozzles 21 in step S34*a* than in step S32.

After step S34*a*, the controller 10 performs the wiping process (S4*c*) as in the first embodiment.

After step S34, the controller 10 performs the processing in step S5 as in the first embodiment, and ends the routine.

As describe above, the present embodiment has the advantageous effects described below, in addition to the same advantageous effects as produced in the first embodiment using the same structure as in the first embodiment.

Figure 9:
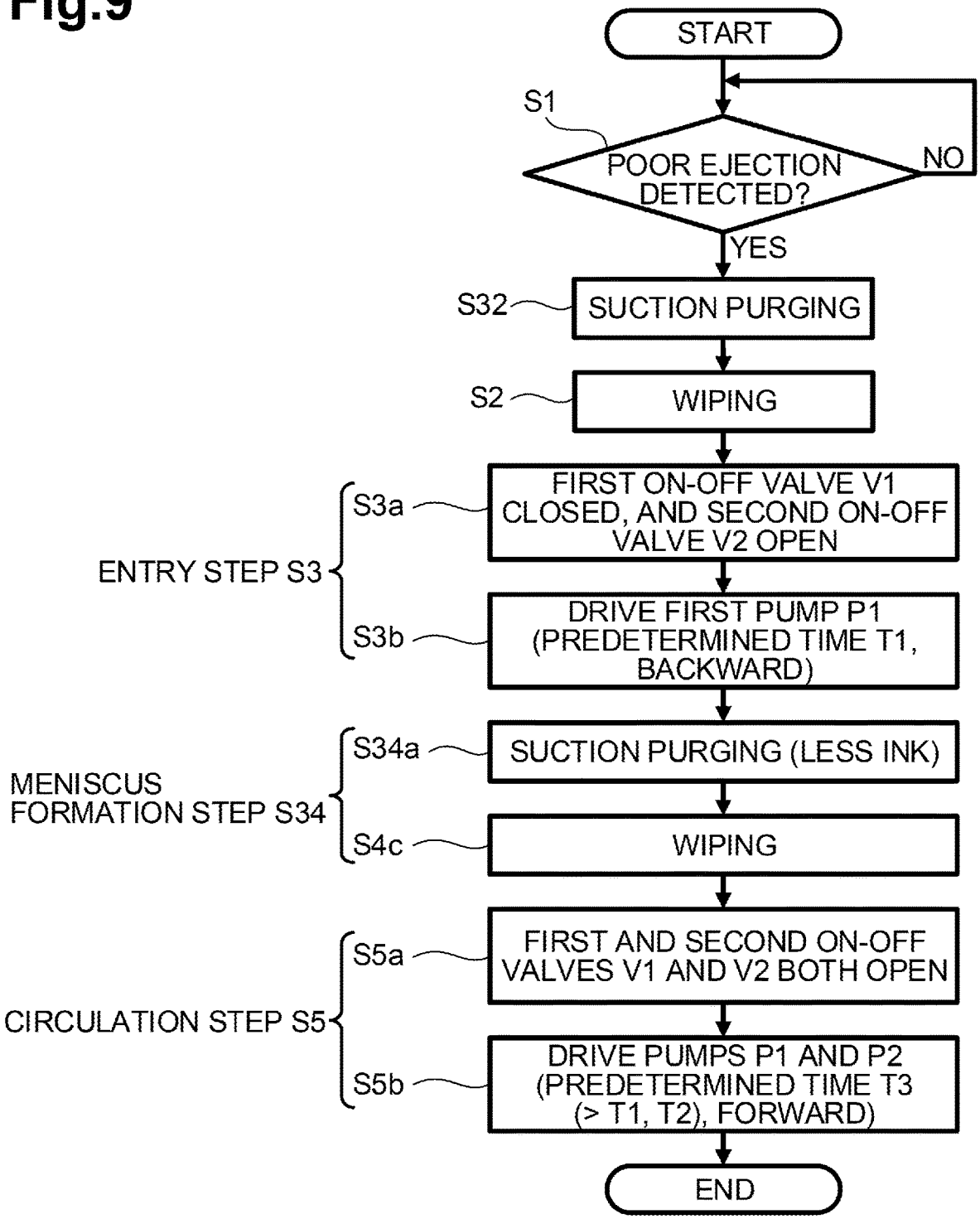
FIG. 9 is a flowchart showing control for eliminating air bubbles in the individual channels 20 in the head 1 according to a third embodiment.

In the meniscus formation step S34, the controller 10 drives the suction pump 6*p* to draw the ink out of the nozzles 21 in the individual channels 20 (refer to step S34*a* in FIG. 9). Relatively simple control using the suction pump 6*p* causes menisci to form in the nozzles 21 in a reliable manner.

Before the entry step S3, the controller 10 drives the suction pump 6*p* to draw the ink out of the nozzles 21 in the individual channels 20 (refer to step S32 in FIG. 9). In this case, foreign matter (e.g., powdery paper dust) is removed off the nozzle surfaces 11$x$ before the entry step S3 with a suction force acting on the nozzle surfaces 11$x$. This prevents foreign matter from entering the individual channels 20 through the nozzles 21 together with air A in the entry step S3.

Fourth Embodiment

A printer according to a fourth embodiment of the present invention will now be described with reference to FIG. 10. The fourth embodiment differs from the first embodiment in that an ejection flush process is performed after step S1 and before step S2 to eliminate air bubbles in the individual channels 20 (S42), and also the actuator 12$x$ (refer to FIG. 3) is used instead of the valves V1 and V2 and the pumps P1 and P2 to perform to perform a non-ejection flush process S44$a$ in a meniscus formation step S44.

In the present embodiment, the controller 10 performs the ejection flush process (S42) when detecting poor ejection through the nozzles 21 (Yes in step S1). In step S42, the controller 10 controls the driver IC 1$d$ in each head 1 to drive all the actuators 12$x$ (refer to FIG. 3) at the same time. This causes the ink to be ejected thorough all the nozzles 21 in each head 1. Together with the ink, any foreign matter (e.g., powdery paper dust) adhering to the periphery of the nozzles 21 is also discharged out of the nozzles 21.

In step S42, the actuator 12$x$ may be driven for a very short time (e.g., 1 s) to reduce ink consumption.

After step S42, the controller 10 performs the processing in steps S2 and S3 (S3$a$ and S3$b$) as in the first embodiment.

After step S3, the controller 10 forms menisci in the nozzles 21 in all the individual channels 20 in each head 1 (S44: meniscus formation step). In step S44, the controller 10 first performs the non-ejection flush process (S44$a$). The controller 10 controls the driver IC 1$d$ in each head 1 to drive all the actuators 12$x$ (refer to FIG. 3) at the same time. In this process, ink is not ejected through any of the nozzles 21 in each head 1, and the ink (meniscus) in each nozzle 21 vibrates.

When the actuator 12$x$ is driven for too long in step S44$a$, high-speed recording cannot be achieved. When the actuator 12$x$ is driven for too short, menisci may not form sufficiently. The operating time may be, for example, about 1 s.

After step S44$a$, the controller 10 performs the wiping process (S4$c$) as in the first embodiment.

After step S44, the controller 10 performs the processing in step S5 as in the first embodiment, and ends the routine.

As describe above, the present embodiment has the advantageous effects described below, in addition to the same advantageous effects as produced in the first embodiment using the same structure as in the first embodiment.

Figure 10:
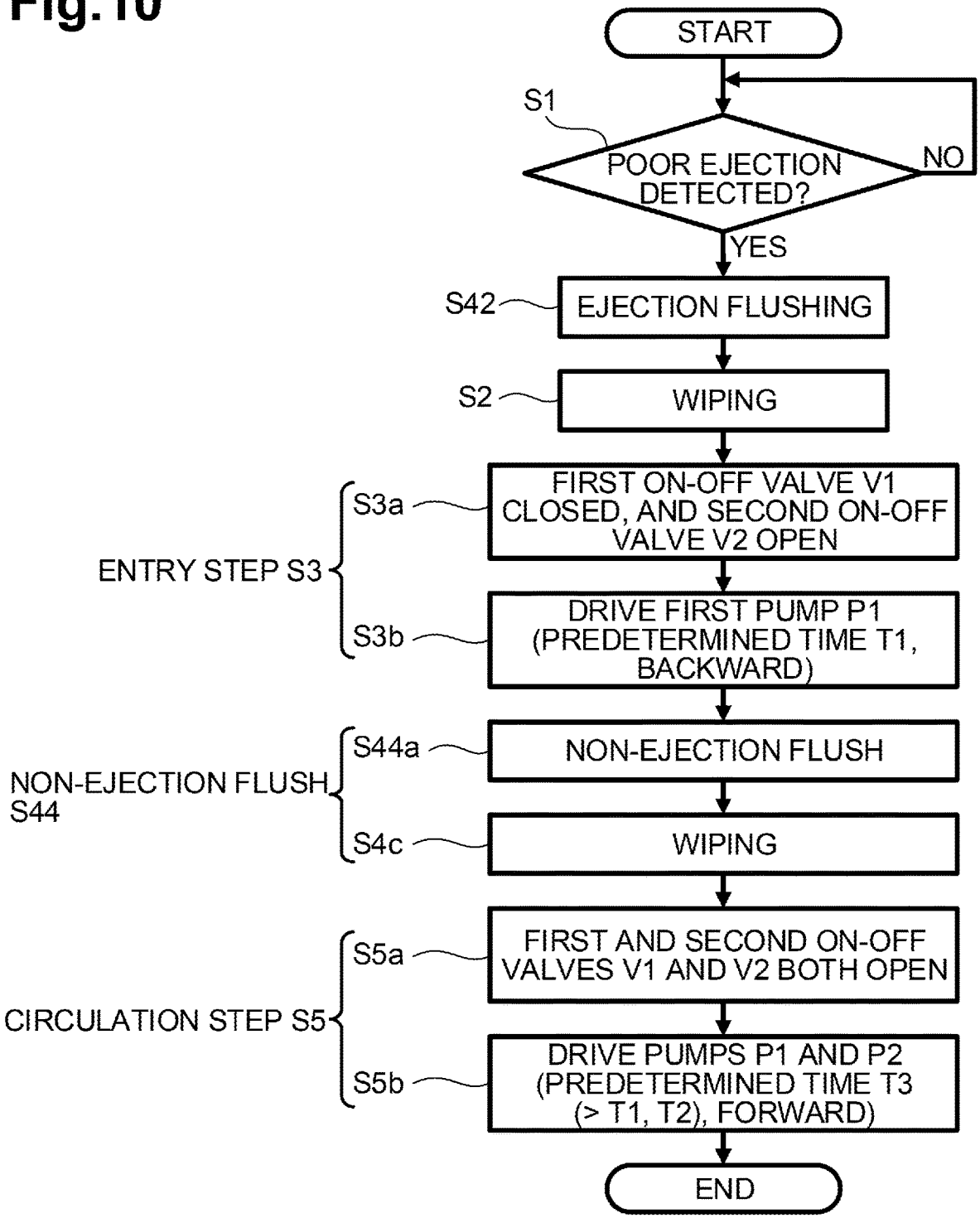
FIG. 10 is a flowchart showing control for eliminating air bubbles in the individual channels 20 in the head 1 according to a fourth embodiment.

In the meniscus formation step S44, the controller 10 drives the plurality of actuators 12$x$ (refer to step S44$a$ in FIG. 10). Relatively simple control using the actuators 12$x$ causes menisci to form in the nozzles 21 in a reliable manner.

Before the entry step S3, the controller 10 drives the plurality of actuators 12$x$ to eject the ink through the nozzles 21 (refer to step S42 in FIG. 10). Together with the ink, any foreign matter (e.g., powdery paper dust) adhering to the periphery of the nozzles 21 is discharged out of the nozzles 21 before the entry step S3. This prevents foreign matter from entering the individual channels 20 through the nozzles 21 together with air A in the entry step S3.

Modifications

Although one or more embodiments of the present invention are described above, the present invention may be embodied differently, and variously designed within the scope of the appended claims.

The controller may perform the entry step at any time (e.g., at constant time intervals) without relying on detection of poor ejection through the nozzles.

Before the entry step, the controller may perform one or more processes selected from the wiping process, the suction purge process, and the ejection flush process. In some embodiments, the controller may not perform any of the wiping process, the suction purge process, and the ejection flush process before the entry step.

In the entry step, the controller may not force air to at least one of the feed channel and the feedback channel, and may force air to the inlet or the outlet of each individual channel, one end of each individual channel, or the communication channel located directly above the nozzle.

In the entry step, the controller may drive both the pumps P1 and P2 (refer to FIG. 2) with the first on-off valve V1 and the second on-off valve V2 open. The pump P1 applies a pressure acting from the feedback channel 32 toward the feed channel 31 to a liquid, and the pump P2 applies a pressure acting from the feed channel 31 toward the feedback channel 32 to the liquid (more specifically, the two pumps P1 and P2 each cause a suction force toward the reservoir 7$a$ to act on the nozzles 21). This may force air into the individual channels 20 through the nozzles 21. In this case, the air may enter both the feed channel 31 and the feedback channel 32. In some embodiments, the pumps P1 and P2 may each apply an adjusted pressure to the ink to cause the suction force toward the reservoir 7$a$ to act on the nozzles 21, drawing air into the individual channels 20 through the nozzles 21. For example, the pressures with different absolute values may be applied to the ink from the pumps P1 and P2. More specifically, when the pumps P1 and P2 operate forward, the absolute value of the pressure applied from the second pump P2 to the ink may be greater than the absolute value of the pressure applied from the first pump P1 to the ink. This draws air through the nozzles 21. The first pump P1 may have a pressure of +1 kPa, and the second pump P2 may have a pressure of −5 kPa.

In step S44$a$ in the third embodiment (FIG. 10), the controller may perform an ejection flush process instead of the non-ejection flush process.

In the meniscus formation step, the controller may perform one or more processes selected from driving the pumps for circulation, the wiping process, the suction purge process, and driving the actuators (the non-ejection flush process or the ejection flush process).

The head 1 may include one or more pumps, and may include, for example, a single pump.

The head 1 may include any number of on-off valves, or may include no on-off valve.

Each individual channel includes one nozzle in the above embodiments, but may include two or more nozzles in some embodiments.

Figure 11:
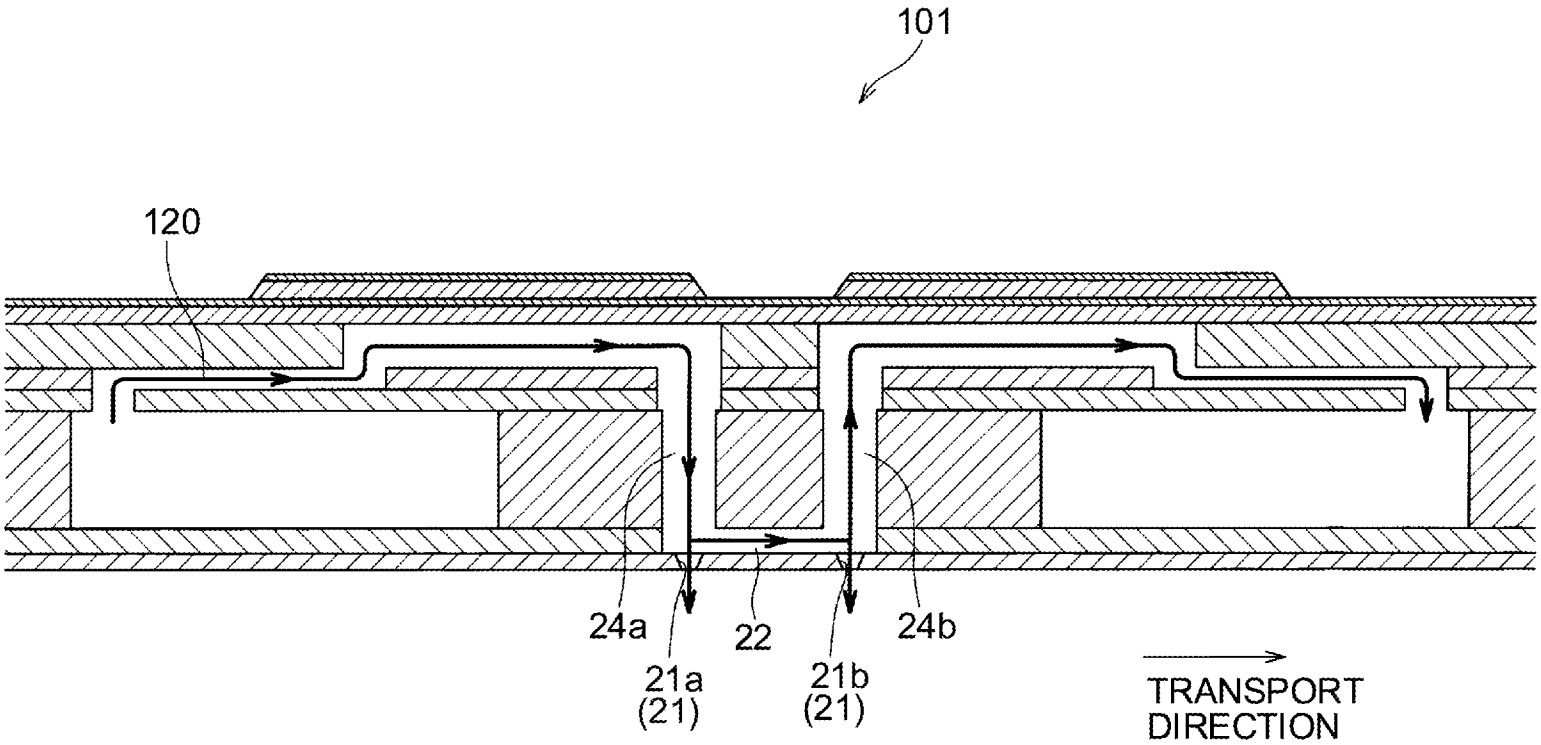
FIG. 11 is a cross-sectional view of a head 101 included in a printer according to a first modification.

For example, a head 101 in FIG. 11 includes two nozzles 21 in each individual channel 120. The nozzles 21 include a first nozzle 21$a$ located directly below the first connection channel 24$a$ and at one end of the communication channel 22 in the transport direction, and a second nozzle 21$b$ located directly below the second connection channel 24$b$ and at the other end of the communication channel 22 in the transport direction. The ink flowing downward through the first connection channel 24$a$ into the communication channel 22 flows horizontally through the communication channel 22 while partially being ejected through the first nozzle 21$a$. The remaining ink further flows, and is further partially ejected through the second nozzle 21*b*. The remaining ink flows upward through the second connection channel 24*b*.

Each individual channel includes two pressure chambers in the above embodiments, but may include a single pressure chamber or three or more pressure chambers.

Figure 12:
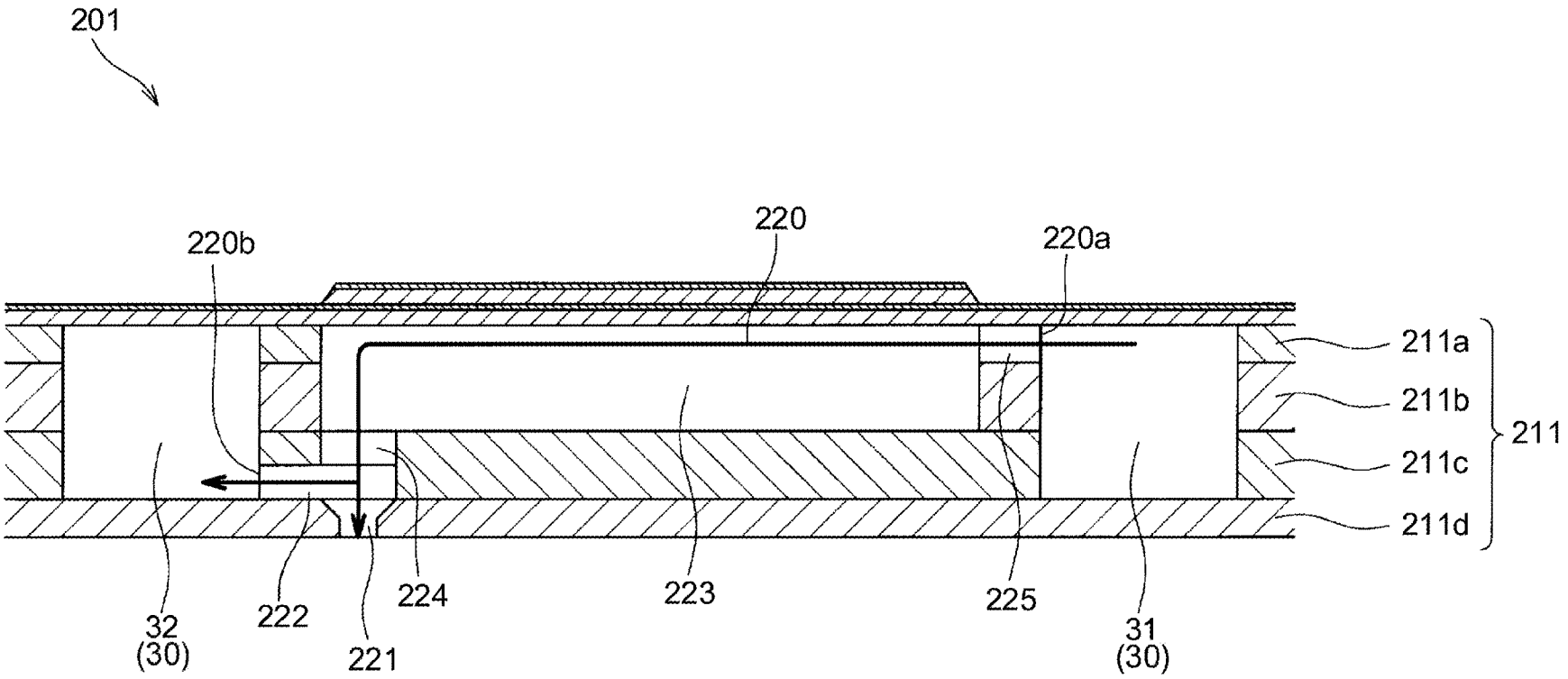
FIG. 12 is a cross-sectional view of a head 201 included in a printer according to a second modification.

For example, a head 201 in FIG. 12 may have a single pressure chamber 223 in each individual channel 220. The head 201 includes a channel substrate 211 including four plates 211*a* to 211*d* that are bonded together. The plates 211*a* to 211*c* include the common channels 30 (the feed channel 31 and the feedback channel 32). The plates 211*a* to 211*d* include a plurality of individual channels 220. Each individual channel 220 includes a nozzle 221, a communication channel 222, a pressure chamber 223, a connection channel 224, and a linking channel 225. The pressure chamber 223 communicates with the feed channel 31 through the linking channel 225, and with the nozzle 221 through the connection channel 224 and the communication channel 222. The communication channel 222 is located directly above the nozzle 221. The communication channel 222 is located between the connection channel 224 and the nozzle 221, and between the connection channel 224 and the feedback channel 32. The communication channel 222 extends from a side of the feedback channel 32. The linking channel 225 extends from a side of the feed channel 31. Each individual channel 220 includes an inlet 220*a* connected to the feed channel 31 and an outlet 220*b* connected to the feedback channel 32. The inlet 220*a* corresponds to an end of the linking channel 225 opposite to the pressure chamber 223. The outlet 220*b* corresponds to an end of the communication channel 222 opposite to the connection channel 224. The ink entering each individual channel 220 flows horizontally through the linking channel 225 and the pressure chamber 223, and downward through the connection channel 224 into the communication channel 222. The ink flowing horizontally through the communication channel 222 is partially ejected through the nozzle 221. The remaining ink flows into the feedback channel 32.

Figure 13:
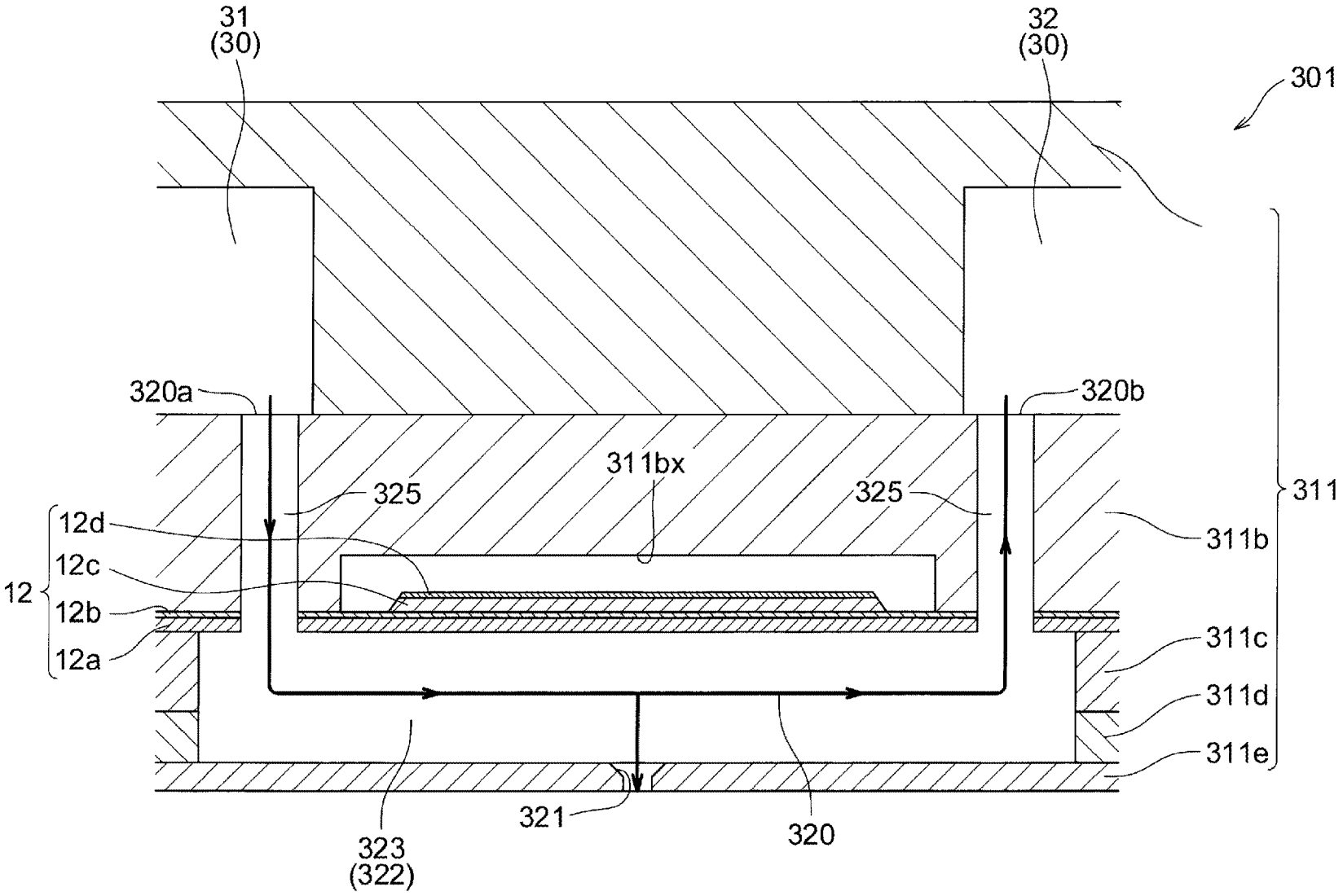
FIG. 13 is a cross-sectional view of a head 301 included in a printer according to a third modification.

For example, a head 301 in FIG. 13 includes one pressure chamber 323 in each individual channel 320. The head 301 includes a channel substrate 311 including five plates 311*a* to 311*e* that are bonded together. The plate 311*a* includes the common channels 30 (the feed channel 31 and the feedback channel 32). The plates 311*b* to 311*e* include a plurality of individual channels 320. The individual channels 320 are located below the common channels 30. Each individual channel 320 includes a nozzle 321, a pressure chamber 323 (communication channel 322), and two linking channels 325. The pressure chamber 323 corresponds to the communication channel 322 located directly above the nozzle 321. More specifically, the pressure chamber 323 located directly above the nozzle 321 directly communicates with the nozzle 321 without any connection channel. The plate 311*b* has, on its lower surface, a recess 311*bx* facing the pressure chamber 323. The plate 311*b* is bonded to the upper surface of the plate 311*c* with the recess 311*bx* accommodating the individual electrode 12*d* and the piezoelectric element 12*c* included in the actuator unit 12. The diaphragm 12*a* and the common electrode 12*b* in the actuator unit 12 extend across substantially the entire upper surface of the plate 311*c*, and cover the pressure chamber 323. The linking channels 325 are through-holes in the plate 311*b*, the diaphragm 12*a*, and the common electrode 12*b*. One of the two linking channels 325 extends upward from the pressure chamber 323 and connects to the feed channel 31. The other one of the two linking channels 325 extends upward from the pressure chamber 323 and connects to the feedback channel 32. Each individual channel 320 includes an inlet 320*a* connecting to the feed channel 31 and an outlet 320*b* connecting to the feedback channel 32. The inlet 320*a* corresponds to an end of one linking channel 325 opposite to the pressure chamber 323. The outlet 320*b* corresponds to an end of the other linking channel 325 opposite to the pressure chamber 323. The ink entering each individual channel 320 flows downward through one linking channel 325 into the pressure chamber 323. The ink reaching the pressure chamber 323 flows horizontally while party being ejected through the nozzle 321. The remaining ink flows upward through the other linking channel 325 into the feedback channel 32.

A single head may include any number of feed channels and any number of feedback channels. For example, a single head may include two or more feed channels and/or two or more feedback channels.

The actuator is not limited to a piezo actuator including a piezoelectric element. The actuator may be another type of actuator (such as a thermal actuator including a heat generator or an electrostatic actuator based on an electrostatic force).

The head may not be used in a line printer but may be used in a serial printer, in which the head ejects a liquid through nozzles to a target while moving in a scanning direction parallel to the sheet width direction.

A target to which a liquid is ejected is not limited to a sheet of paper, and may be, for example, a cloth or a substrate.

The nozzles may eject any liquid other than ink (e.g., a treatment liquid for causing aggregation or precipitation of the components in the ink).

In the above embodiments, the head unit 1*x* is moved relative to the wiper 5 and the cap unit 6*x*. In some embodiments, the head may be fixed, and the wiper and the cap may be moved relative to the head.

The embodiments of the present invention are applicable not only to printers but also to, for example, fax machines, copying machines, and multifunction printers. The embodiments of the present invention are also applicable to liquid ejection apparatuses for use in applications other than image recording (e.g., a liquid ejection apparatus that forms conductive patterns by ejecting a conductive liquid onto a substrate).

What is claimed is:

1. A liquid ejection apparatus comprising:

a head defining:

an individual channel including a nozzle;

a feed channel communicating a reservoir and an inlet port of the individual channel;

a feedback channel communicating the reservoir and an outlet port of the individual channel;

a pump assembly including at least one pump; and a controller configured to, drive the pump assembly to draw air into the individual channel through the nozzle, and drive the pump assembly to apply a pressure in the individual channel from the feed channel toward the feedback channel.

2. A liquid ejection apparatus according to claim 1, wherein the controller is configured to drive the pump assembly to apply a pressure from at least one of the feed channel or the feedback channel to the nozzle.

3. A liquid ejection apparatus according to claim 1, wherein the individual channel includes:

a communication channel located directly above the nozzle; and a large channel extending from the communication channel, the large channel having a larger cross section than a cross section of the communication channel, wherein the controller is configured to drive the pump assembly to force air to one end of the large channel opposite the communication channel when the controller drives the pump assembly to draw air into the individual channel through the nozzle.

4. A liquid ejection apparatus according to claim 3, wherein the controller is configured to drive the pump assembly to draw air to one of the inlet port or the outlet port of the individual channel.

5. A liquid ejection apparatus according to claim 4, wherein the controller is configured to drive the pump assembly to draw air to one of the feed channel or the feedback channel.

6. A liquid ejection apparatus according to claim 1, wherein a pressure to draw air into the individual channel is larger than a pressure to circulate liquid between the feed channel to the feedback channel.

7. A liquid ejection apparatus according to claim 1, wherein the controller is configured to drive the pump assembly to draw air into the individual channel through the nozzle for a predetermined time.

8. A liquid ejection apparatus according to claim 1, further comprising:

a first on-off valve located between the feedback channel and the reservoir, wherein the at least one pump includes:

a first pump located between the feed channel and the reservoir, wherein the controller is configured to drive the first pump to apply a pressure from the feedback channel to the feed channel with the first on-off valve closed to draw air into the individual channel through the nozzle.

9. A liquid ejection apparatus according to claim 1, further comprising:

a first on-off valve located between the feed channel and the reservoir, wherein the at least one pump includes:

a first pump located between the feedback channel and the reservoir, wherein the controller is configured to drive the first pump to apply a pressure from the feed channel to the feedback channel with the first on-off valve closed to draw air into the individual channel through the nozzle.

10. A liquid ejection apparatus according to claim 8, further comprising:

a second on-off valve located between the feed channel and the reservoir;

wherein the at least one pump further includes a second pump located between the feedback channel and the reservoir, wherein the controller drives the first pump to apply a pressure from feedback channel to the feed channel with the first on-off valve closed and the second on-off valve open to draw air into the individual channel through the nozzle, and wherein the controller drives the second pump to apply a pressure from the feedback channel to the feed channel with the first on-off valve open and the second on-off valve closed to form a menisucus in the nozzle.

11. A liquid ejection apparatus according to claim 9, further comprising:

a second on-off valve located between the feedback channel and the reservoir;

wherein the at least one pump further includes a second pump located between the feed channel and the reservoir, wherein the controller drives the first pump to apply a pressure from feed channel to the feedback channel with the first on-off valve closed and the second on-off valve open to draw air into the individual channel through the nozzle, and wherein the controller drives the second pump to apply a pressure from the feed channel to the feedback channel with the first on-off valve open and the second on-off valve closed to form a menisucus in the nozzle.

12. A liquid ejection apparatus according to claim 10, wherein a pressure to cause the meniscus by the second pump is larger than a pressure to circulate liquid between the feed channel and the feedback channel.

13. A liquid ejection apparatus according to claim 10, wherein the controller is configured to drive the first pump to draw for a first time, and wherein the controller is configured to drive the second pump to cause the menisucus for a second time shorter than the first time.

14. A liquid ejection apparatus according to claim 1, further comprising:

a suction pump; and wherein the controller is configured to drive the suction pump to create a pressure from the individual channel to the nozzle to form a menisucus in the nozzle.

15. A liquid ejection apparatus according to claim 1, wherein the individual chamber includes a pressure chamber in communication with the nozzle, and an actuator facing the pressure chamber, wherein the controller drives the actuator to form the menisucus.

16. A liquid ejection apparatus according to claim 1, further comprising a wiper, wherein the controller is configured to move a surface of the nozzle relative to the wiper such that the surface of the nozzle contacts the wiper to form a menisucus in the nozzle.

17. A liquid ejection apparatus according to claim 1, wherein the individual path has:

two pressure chambers;

a communication channel located directly above the nozzles and in communication with the nozzle; and wherein each of the two pressure chambers are in communication with the communication channel.

18. A liquid ejection apparatus according to claim 1, wherein the controller is configured to detect poor ejection through the nozzle, and wherein the controller is configured to drives the pump assembly to draw the air in response to the controller detecting the poor ejection through the nozzle.

19. A liquid ejection apparatus according to claim 1, wherein the pump assembly includes a first operation for applying a pressure acting from the feed channel toward the feedback channel, and a second operation for applying a pressure acting from the feedback channel toward the feed channel to the liquid, wherein the controller drives the pump in the second operation to draw air, and wherein the controller is configured to drive the pump in the first operation to circulate liquid from the feed channel to the feedback channel.

20. A liquid ejection apparatus according to claim 1, wherein the pump assembly includes a first operation for applying a pressure acting from the feed channel toward the feedback channel, wherein the controller is configured to drive the pump in the first operation to draw the air into the individual channel and to apply the pressure in the individual channel from the feed channel toward the feedback channel.

21. A method comprising:

providing a liquid ejection apparatus head that defines an individual channel including a nozzle, a feed channel communicating a reservoir and an inlet port of the individual channel, and a feedback channel communicating the reservoir and an outlet port of the individual channel;

drawing air through the nozzle into the individual channel;

creating liquid flow from at least one of the feed channel or the feedback channel through the individual channel to the nozzle; and creating liquid flow from the feed channel through the individual channel toward the feedback channel.

22. The method of claim 21, further comprising, after creating the liquid flow to the nozzle, wiping the nozzle to form a meniscus in the nozzle.

23. The method of claim 21, wherein drawing air through the nozzle into the individual channel includes drawing air towards the feed channel.

24. The method of claim 21, wherein drawing air through the nozzle into the individual channel includes drawing air towards the feedback channel.

25. The method of claim 21, wherein drawing air through the nozzle into the individual channel includes preventing fluid flow between the reservoir and the feedback channel, and creating a pressure from the feed channel towards the reservoir.

26. The method of claim 21, wherein drawing air through the nozzle into the individual channel includes preventing fluid flow between the reservoir and the feed channel, and creating a pressure from the feedback channel towards the reservoir.

27. The method of claim 21, wherein creating liquid flow to the nozzle includes preventing fluid flow between the feed channel and the reservoir, and creating a pressure from the reservoir towards the feedback channel.

28. The method of claim 27, further comprising pumping fluid from the reservoir towards the feedback channel.

29. The method of claim 27, wherein creating a pressure from the reservoir towards the feedback channel includes applying a suction to the nozzle.

30. The method of claim 27, wherein creating a pressure from the reservoir towards the feedback channel includes applying a pressure to the individual channel.

31. The method of claim 21, wherein creating liquid flow to the nozzle includes preventing fluid flow between the feedback channel and the reservoir, and creating a pressure from the reservoir towards the feed channel.

32. The method of claim 21, wherein creating wherein creating liquid flow to the nozzle includes pumping fluid from the reservoir to the feedback channel.

33. The method of claim 21, wherein creating wherein creating liquid flow to the nozzle includes creating a suction at the nozzle.

34. The method of claim 21, wherein creating wherein creating liquid flow to the nozle includes applying a pressure to the individual channel.

* * * * *